US005937750A

United States Patent [19]

Takeda

[11] Patent Number: 5,937,750

[45] Date of Patent: Aug. 17, 1999

[54] STENCIL PRINTER HAVING AN ELECTRIC FIELD BETWEEN THE PRINT DRUM AND THE PRESSING MEMBER

[75] Inventor: Fuchio Takeda, Fukushima, Japan

[73] Assignee: Tohoku Ricoh Co., Ltd., Miyagi-ken, Japan

[21] Appl. No.: 08/861,082

[22] Filed: May 21, 1997

[30] Foreign Application Priority Data

May 21, 1996 [JP] Japan ..... 8-125457
Apr. 25, 1997 [JP] Japan ..... 9-108546

[51] Int. Cl.[6] ..... B41L 13/06; B41M 1/12

[52] U.S. Cl. ..... 101/116; 101/119

[58] Field of Search ..... 101/114, 116, 101/119, 120, 126, 129, 153

[56] References Cited

U.S. PATENT DOCUMENTS

| | | | |
|---|---|---|---|
| 3,902,414 | 9/1975 | Zimmer et al. | 101/116 |
| 4,697,514 | 10/1987 | George et al. | 101/153 |
| 5,322,011 | 6/1994 | Hahne et al. | 101/153 |
| 5,355,794 | 10/1994 | Freudenheim | 101/129 |
| 5,517,913 | 5/1996 | Oshio et al. | 101/119 |

FOREIGN PATENT DOCUMENTS

| | | | |
|---|---|---|---|
| 2245259 | 3/1974 | Germany | 101/120 |
| 8289 | 1/1981 | Japan | 101/120 |
| 274979 | 12/1986 | Japan | 101/114 |
| 2-151473 | 6/1990 | Japan . | |
| 4-35982 | 2/1992 | Japan . | |
| 4-59384 | 2/1992 | Japan . | |

*Primary Examiner*—Stephen R. Funk
*Attorney, Agent, or Firm*—Oblon, Spivak, McClelland, Maier & Neustadt, P.C.

[57] ABSTRACT

A stencil printer of the present invention includes a print drum and a pressing member. After a cut stencil or master has been wrapped around the print drum, the pressing member presses a paper or similar recording medium against the master. As a result, ink fed to the print drum oozes out to the paper and prints a desired image thereon. When the pressing member presses the paper against the master, an electric field is formed between the pressing member and the print drum in the direction in which the ink migrates from the drum to the paper. The printer is capable of adjusting image density without varying a mechanical pressure to act on the drum or varying the print speed.

39 Claims, 16 Drawing Sheets

CURRENT
H
G
F
VARIATION OF CURRENT
TIME
E
I
i
J
K
1
0
OUTPUT OF TIMER 82
TIME
1
0
TIME COUNTED BY MEANS 83
TIME

STENCIL PRINTER HAVING AN ELECTRIC FIELD BETWEEN THE PRINT DRUM AND THE PRESSING MEMBER

BACKGROUND OF THE INVENTION

The present invention relates to a stencil printer and, more particularly, to a stencil printer capable adjusting the density of an image to be printed on a recording medium.

Some different methods are available with a stencil printer for adjusting the density of an image to be printed on a paper or similar recording medium. For example, there may be adjusted the amount of ink to be fed to an ink roller, the pressure to be executed by the ink roller on a print drum, or a pressure to be executed by a press roller on the print drum. Among them, the adjustment of the amount of ink to be fed to the ink roller can be done by adjusting the gap between the ink roller and a doctor roller. However, this kind of adjustment is difficult because the gap between the above rollers is small and because the gap must be uniformly adjusted over the entire length of the rollers. The adjustment of the pressure to be executed by the ink roller on the print drum is also difficult because the pressure must be adjusted uniformly over the entire length of the ink roller. By contrast, the pressure to be executed by the press roller on the print drum can be comparatively easily adjusted because the pressure should only be variable. This kind of scheme is taught in, e.g., Japanese Patent Laid-Open Publication No. 2-151473.

The problem with a conventional print drum formed with pores in a low density is that the amount of ink to infiltrate into a paper greatly depends on whether or not an image aligns with the pores. It is therefore likely that blurring, offset and other defects occur due to local increase in the amount of ink even when the average image density is low. A current trend in the stencil printers art is toward a print drum formed with pores of small diameter in a high density in order to reduce the offset and blurring and to increase the average image density. While this kind of print drum is usually produced by etching, the minimum diameter of the pores is substantially determined by the thickness of a sheet constituting the drum. Therefore, should the diameter of the pores be excessively reduced in order to increase the density of the pores, the drum would be reduced in thickness and therefore rigidity.

Assume that the adjustment of the pressure of the press roller stated previously is applied to the drum whose rigidity is low. Then, when the press roller presses the drum, the drum yields easily and prevents the expected pressure to act on an ink layer, i.e., the pressure necessary for printing from being set up. As a result, the amount of ink oozing out from the drum is too small to produce a high quality printing. Should the pressure to act on the drum be increased in order to increase the amount of ink, the drum would greatly deform and would cause members supporting the drum to break. In addition, such a high pressure would lower the durability of the drum and would aggravate noise ascribable to the contact of the pressing member with the drum. Moreover, after the drum has been pressed by the pressing member, it resiliently restores its original position. If the drum is excessively deformed by the high pressure, it is apt to fail to restore. Once the drum deforms, the deformed portion of the drum appears on a printing as a defective image. The drum should be bodily replaced if its deformation exceeds an allowable limit. Therefore, when the drum has low rigidity, there is a demand for a method capable of adjusting image density without varying the mechanical pressure to act on the drum of the printer.

Varying the print speed is another prior art implementation for adjusting the image density. This kind of approach, however, varies the time when a printing is to be output from the printer, and thereby lowers productivity.

SUMMARY OF THE INVENTION

It is therefore an object of the present invention to provide a stencil printer capable of adjusting image density without varying the mechanical pressure to act on the print drum or varying the print speed.

A stencil printer of the present invention includes a print drum to be fed with ink with a master wrapped therearound. A pressing member presses a recording medium against the master to thereby cause the ink to ooze out onto the recording medium. An electric field forming device forms, when the pressing member presses the recording medium against the master, an electric field between the print drum and the pressing member in the direction in which the ink migrates from the print drum toward the recording medium.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
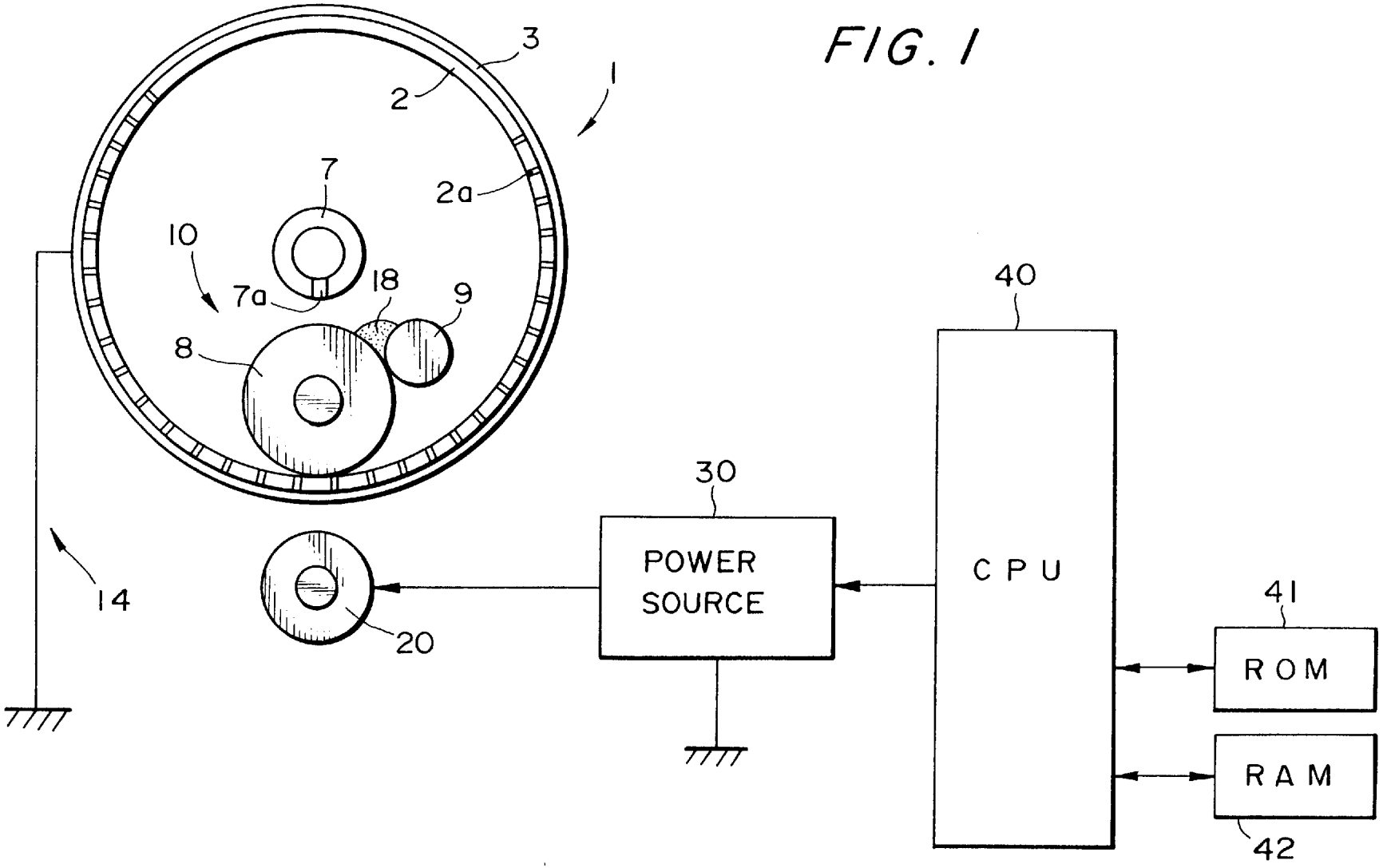
FIG. 1 shows a first embodiment of the stencil printer in accordance with the present invention.
Figure 2:
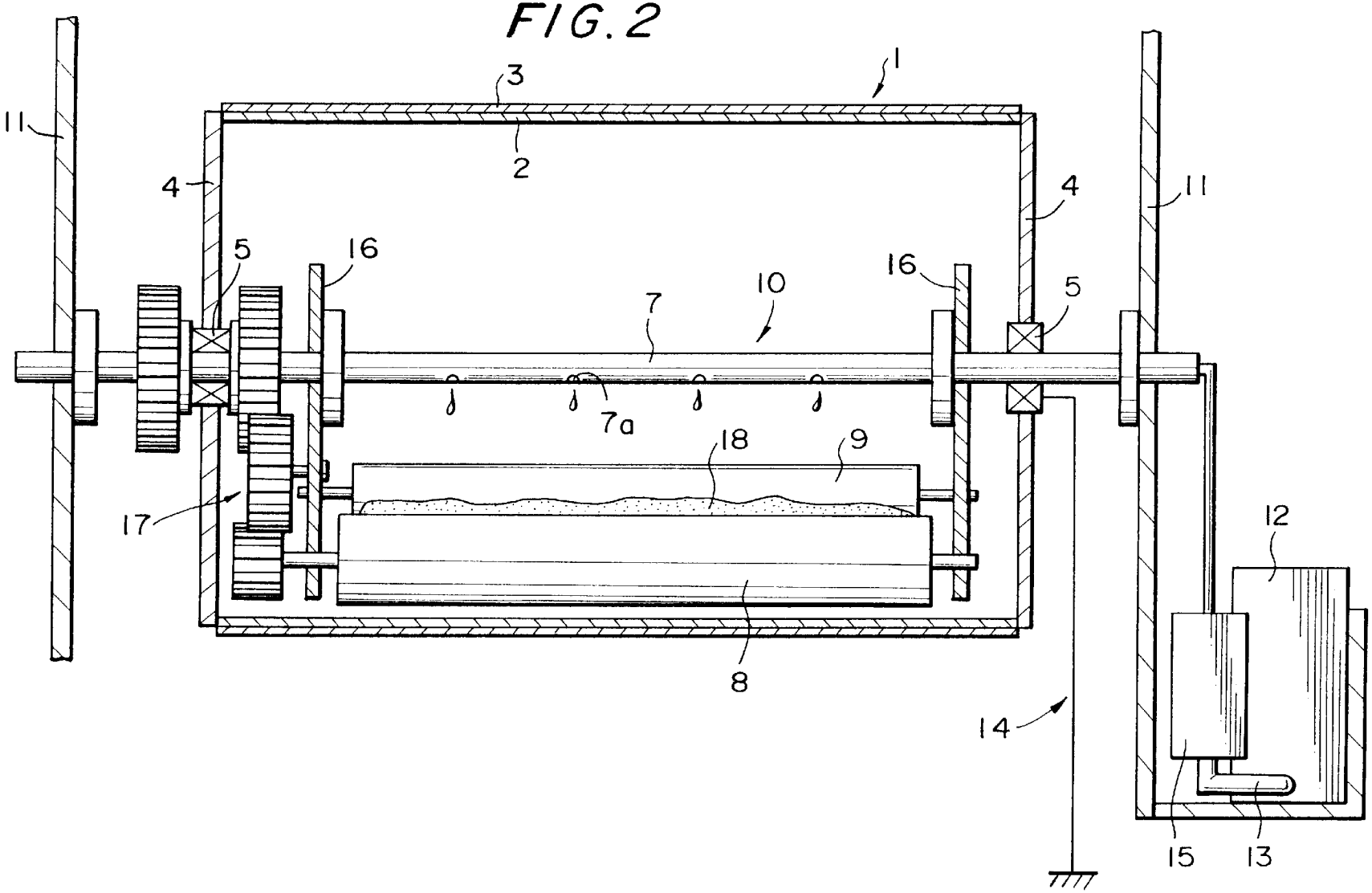
FIG. 2 is a sectional side elevation of a print drum included in the first embodiment.

Referring to FIGS. 1 and 2 of the drawings, a first embodiment of the stencil printer in accordance with the present invention is shown. As shown, the printer includes a print drum 1 rotatable by being driven by drum drive means, not shown. The print drum 1 is made up of a hollow porous cylinder 2 and a screen layer 3 formed on the outer periphery of the cylinder 2. The cylinder 2 is implemented by a sheet of stainless steel and formed with a number of pores 2*a* for passing ink therethrough. A cut stencil, or master, is wrapped around the drum 1, as will be described specifically later. A pair of flanges 4 are mounted on both open ends of the cylinder 2 and also implemented by sheets of stainless steel. The flanges 4 are each mounted on an ink pipe 7, which will be described via a respective conductive bearing 5. The bearings 5 are connected to ground by grounding means 14 in order to form an electric field between the cylinder 2 and a press roller 20 which will be described. For the grounding means 14, use is made of a conventional electric wire. The screen layer 3 is formed of fibers of TETRON, nylon or similar synthetic resin and serves to diffuse ink over the outer periphery of the cylinder 2.

Ink feeding means 10 is disposed in the print drum 1 and has an ink roller 8 and a doctor roller 9 as well as the ink pipe 7. The ink pipe 7, supporting the drum 1 thereon, is affixed to opposite side walls 11 included in a casing. A plurality of small holes 7*a* are formed in the ink pipe 7 in order to feed ink to the inside of the drum 1, i.e., cylinder 2. An ink cartridge, or ink storing member, 12 is fluidly communicated to one end of the ink pipe 7 via a conduit 13. Ink stored in the cartridge 12 has conductivity and may be implemented as carbon-containing emulsion ink by way of example. The cartridge 12 is located outside of the cylinder 2 and removable from the above casing. The conduit 13 includes an ink pump 15 for feeding the ink under pressure from the cartridge 12 to the ink pipe 7. If desired, the cartridge 12 and conduit 13 including the pump 15 may also be disposed in the cylinder 2.

The ink roller 8 and doctor roller 9 are located below the ink pipe 7 within the cylinder 2. The ink roller 8 is rotatably supported by side plates 16 within the cylinder 2. The ink roller 8 is positioned such that its circumferential surface adjoins the inner periphery of the cylinder 2. In this configuration, the ink fed from the ink pipe 7 is transferred to the inner periphery of the cylinder 2 via the ink roller 8. The output torque of the drum drive means is transmitted to the ink roller 8 by drive transmitting means 17 including a plurality of gears. The ink roller 8 therefore rotates in synchronism with and in the same direction as the drum 1.

The doctor roller 9 is also rotatable and located in the vicinity of the ink roller 8. The circumferential surface of the ink roller 8 and that of the doctor roller 9 are spaced by a small gap, forming an ink well 18 having a wedge-like cross-section therebetween. The ink fed from the ink pipe 7 to the ink well 18 is passed through the gap between the two rollers 8 and 9 and deposited on the surface of the roller 8 in the form of a uniform layer.

Figure 3:
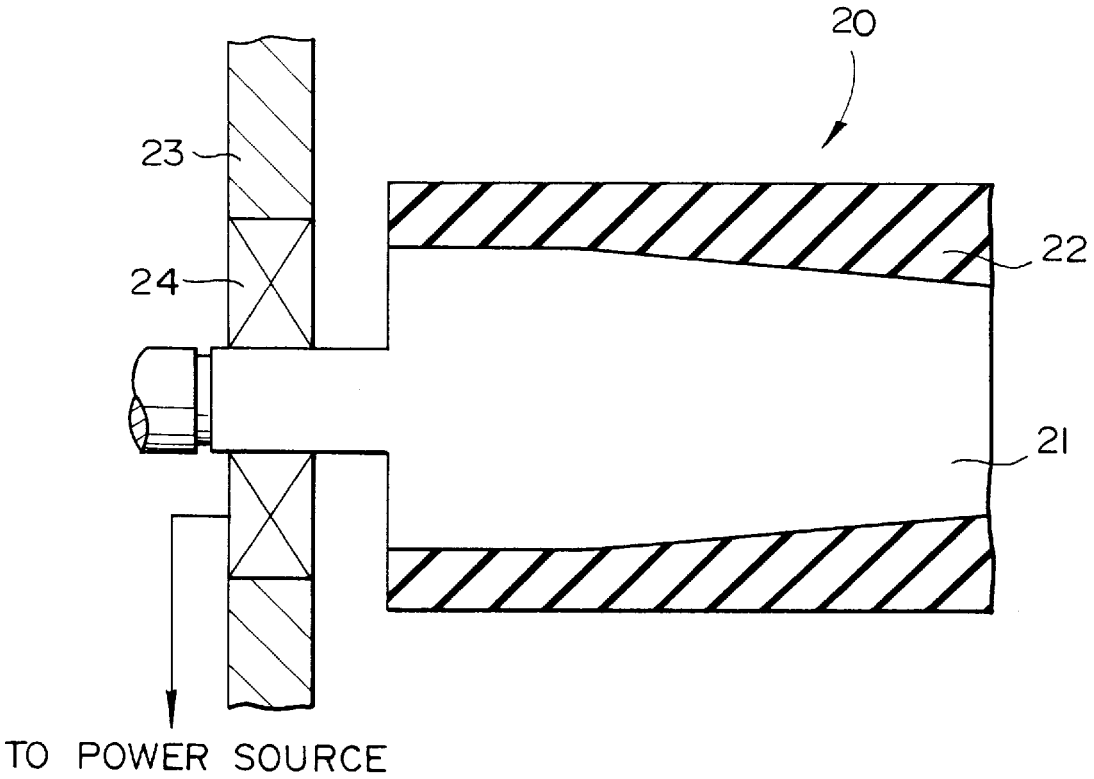
FIG. 3 is a fragmentary sectional side elevation showing a press roller also included in the first embodiment, together with a structure for supporting the press roller.
Figure 4:
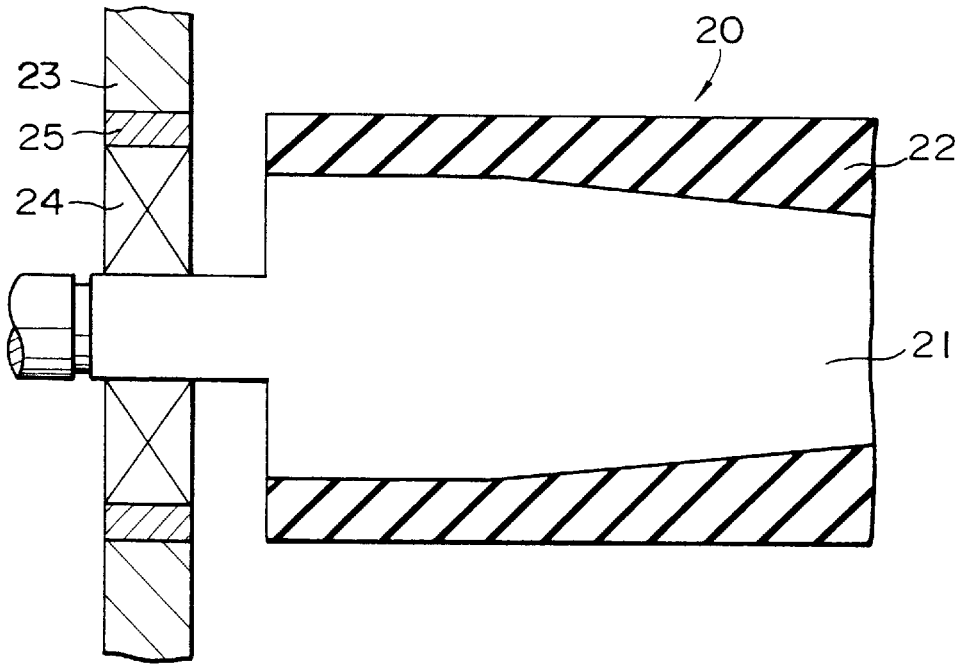
FIG. 4 is a view similar to FIG. 3, showing another specific support structure.

The press roller, or pressing member, 20 is positioned below the drum 1 in order to press a paper or similar recording medium against the drum 1 with the intermediary of a master. Moving means, not shown, selectively moves the roller 20 to a position where the roller 20 is spaced from the drum 1 or to a position where the former is pressed against the latter. As shown in FIG. 3, the roller 20 is made up of a metallic core 21 and a conductive rubber layer 22 wrapped around the core 21 and formed of urethane rubber or nitrile rubber (NBR). The core 21 is rotatably supported at each end thereof by a support arm 23 included in the above moving means via a conductive bearing 24. The support arm 23 is formed of insulating synthetic resin. As shown in FIG. 4, an insulating ring 25 may be provided between the bearing 24 and the support arm 23, in which case the arm 23 will be formed of metal. A conductive lubricant may be applied to the bearings 5 and 24 so as to insure conductivity against aging.

A power source, or power feeding means, 30 is connected to the bearing 23 in order to apply a high voltage to the press roller 20. Why a high voltage is applied to the press roller 20 in place of the cylinder 2 is as follows. A plurality of sensors are disposed in the print drum 1 and include a sensor responsive to the amount of the ink fed to the ink well 18, a sensor responsive to the viscosity of the ink, a sensor responsive to the hue of the ink, a sensor responsive to the electric characteristic of the ink, and a sensor responsive to the magnetism of the ink. Various sensors are also arranged around the drum 1 and include a master sensor and a drum sensor. Such sensors are not shown for the simplicity of illustration. A master feeding device, not shown, is also located in the vicinity of the drum 1 in order to feed a master to the drum 1.

Assume that a high voltage is applied to the cylinder 2 in order to form an electric field between the cylinder 2 and the press roller 20. Then, the above various sensors are apt to malfunction due to noise ascribable to discharge, deteriorating the stability of the printer. By contrast, the voltage applied to the press roller 20 does not bring about such an occurrence because no sensors are arranged around the press roller 20. This successfully enhances the stability of the printer.

A CPU (Central Processing Unit) 40 is connected to the power source 30 in order to selectively apply the voltage to the press roller 20. Specifically, when the press roller 20 presses a paper against the print drum 1, the CPU 40 applies the high voltage from the power source 30 to the press roller 20, forming an electric field between the drum 1 and the press roller 20. At the same time, the CPU 40 controls the various kinds of operation of the entire printer. A ROM (Read Only Memory) 41 and a RAM (Random Access Memory) 42 are connected to the CPU 40 and constitute control means together with the CPU 40. The ROM 41 stores a program for operating the printer while the RAM 42 store temporary data representative of the results of computations. The power source 30 and CPU 40 constitute electric field forming means.

The operation of the printer will be described hereinafter. Assume that the operator sets a document on a document reading section, not shown, and then presses a master start key, not shown, for making a master. In response, the print drum 1 starts rotating. At this instant, a master discharging device, not shown, peels off a used master from the surface of the drum 1 and discharges it. The drum 1 is brought to a stop at a preselected position and waits for a master.

After the used master has been discharged, the document reading section reads the image of the document. A CCD (Charge Coupled Device) image sensor included in the reading section outputs an electric signal representative of the document image. The electric signal is transformed to a digital signal by an analog-to-digital converter, not shown, and then delivered to a master making control device, not shown, as image data. The master making control device cuts, or perforates, a stencil in accordance with the image data. The stencil is made up of a fibrous substrate and a thermoplastic resin layer formed on the substrate. The stencil is paid out from a roll and cut at a preselected length while the perforated part of the stencil, i.e., a master is wrapped around the drum 2.

Subsequently, a paper is fed from paper feeding means, not shown, to a registration roller pair, not shown. This roller pair drives the paper toward the gap between the drum 1 and the press roller 20 at such a timing that the image area of the master arrives at the above gap. The press roller 20 presses the paper against the drum 1 with the intermediary of the master. At this time, the CPU 40 sends a command to the power source 30 for applying the voltage to the press roller 20. In response, the power source 30 applies the high voltage to the press roller 20. As a result, an electric field is formed between the drum 1 connected to ground and the press roller 20 in the direction in which the ink is to be transferred from the inner periphery of the drum 1 to the paper. The pressure of the press roller 20 and the electric field cooperate to transfer the ink to the paper via the pores 2*a* of the cylinder 2, screen layer 3, and master.

The paper to which the ink has been transferred is separated from the outer periphery of the drum 1 by a separator, not shown, and then driven out of the printer by paper discharging means, not shown, as a trial printing. If the operator determines the trial printing to be acceptable and presses a print start key, papers are sequentially fed from the paper feeding means while the drum 1 is continuously rotated at a high speed. This is repeated until a desired number of printings have been produced.

Figure 5:
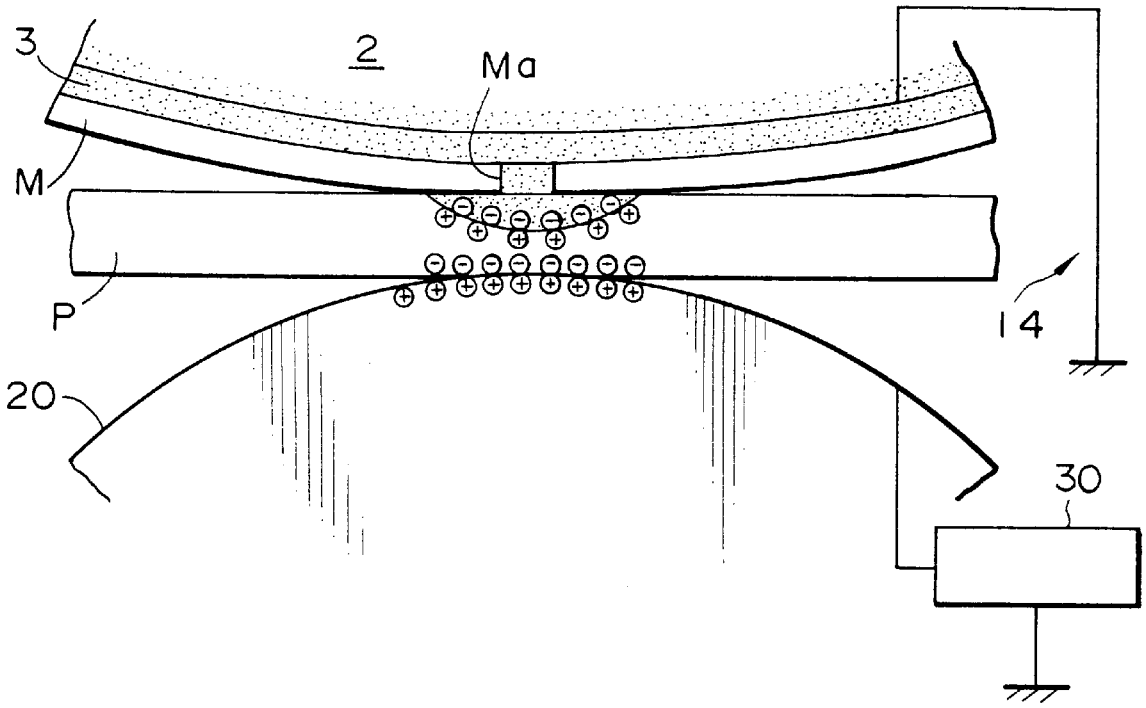
FIG. 5 is a fragmentary enlarged view of the press roller and print drum for describing the migration of ink to occur when an electric field is formed.

The transfer of the ink to the paper effected by the electric field will be described specifically with reference to FIG. 5. There are shown in FIG. 5 a paper P and a master M. Assume that the press roller 20 presses the outer periphery of the drum 1 via the paper P and master M, and that the electric field is formed between the drum 1 and the press roller 20. In this condition, induction charge (negative in this case) is generated in the conductive ink oozing out from a perforation Ma formed in the master M toward the paper P due to the electric field. On the other hand, polarization charge is generated within the paper P due to the electric field. Specifically, negative charge concentrates on the side of the paper P adjoining the press roller 20 while positive charge concentrates on the other side adjoining the drum 1. The ink charged to the negative polarity is attracted by the paper P due to the positive charge of the paper P.

Consequently, the electric field between the press roller 20 and the drum 1 increases the amount in which the ink oozes out from the drum 1. This allows the density of a printed image to be increased without resorting to the adjustment of the amount of the ink to be fed to the ink roller 8, the adjustment of the pressure to be exerted by the ink roller 8 on the cylinder 2, or the adjustment of the pressure of the press roller 20. This is also true even when the cylinder 2 is provided with low rigidity, i.e., formed with the pores 2*a* of small diameter in a high density.

Figure 6:
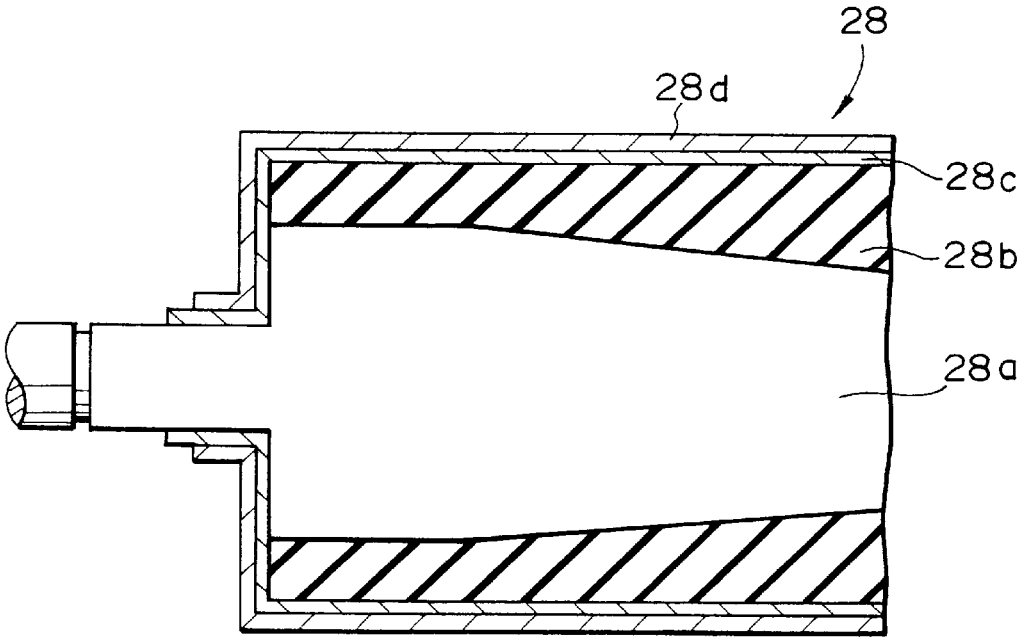
FIG. 6 is a sectional side elevation showing a modified form of the press roller.

FIG. 6 shows a press roller 28 which may be substituted for the press roller 20. As shown, the press roller 28 is made up of a metallic core 28*a,* a rubber layer 28*b* formed on the core 28*a,* a conductive layer 28*c* formed on the rubber layer 28*b,* and an insulating layer 28*d* formed on the conductive layer 28*c*. In this case, the end of the conductive layer 28*c* is extended to the end of the core 28*a,* as illustrated. A conductive elastic member or a conductive brush, not shown, is held in contact with the extended portion of the conductive layer 28*c* for applying the voltage thereto.

Figure 7:
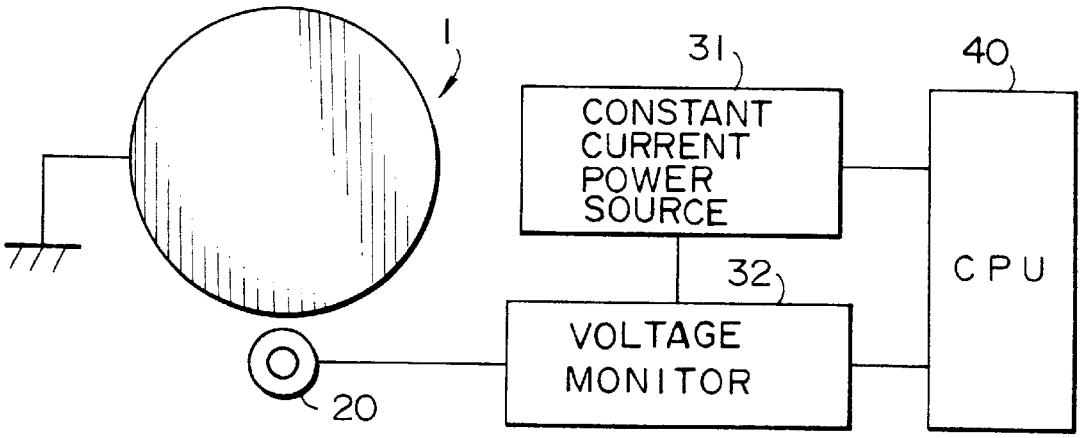
FIG. 7 shows a modification of the first embodiment using a constant current power source.

In a modification of the above embodiment, the power source 30 is implemented as a constant current or constant voltage power source, as follows. FIG. 7 shows a constant current power source 31 which does not feed currents above a preselected value to the press roller 20. Even when the insulating layer of the press roller 20 is damaged or shorted during operation, the power source 31 prevents such a failure from being aggravated. However, the failure adversely effects the power source 31. To protect the power source 31, a voltage monitor 32 is connected between the roller 20 and the power source 31. The voltage monitor 32 senses the voltage applied to the roller 20 while sending the sensed voltage to the CPU 40. The CPU 40 detects an error in terms of a fall of the voltage applied to the roller 20. Specifically, the CPU 40 detects an error by comparing the voltage sensed by the monitor 32 and a preselected reference voltage. When the voltage sensed by the monitor 32 is lower than the reference voltage, the CPU 40 outputs an alarm, determining that a defect has occurred in the roller 20.

Figure 8:
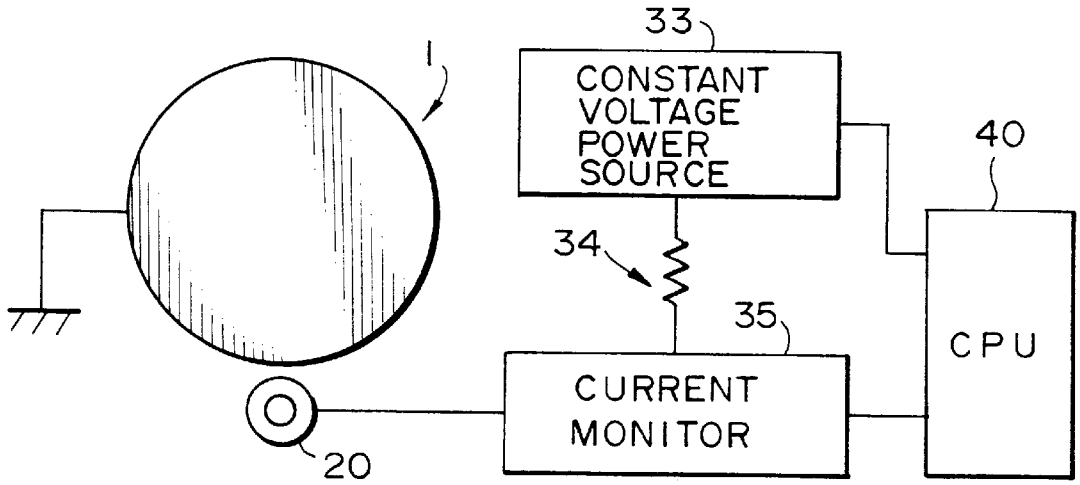
FIG. 8 shows another modification of the first embodiment using a constant voltage power source.

FIG. 8 shows a constant voltage power source 33 replacing the power source 30 and provided with an overcurrent protection device. As shown, a protection resistor 34 is serially connected with the constant voltage power source 33 in order to obviate shorting. While the error detecting circuitry of FIG. 7 is also applied to the arrangement of FIG. 8, a current monitor 35 is substituted for the voltage monitor 32. The current monitor 35 is responsive to the current being fed to the press roller 20. However, the voltage monitor 32 is usable if it monitors the voltage appearing on the end of the press roller 20, because the protection resistor 34 is present.

Figure 9:
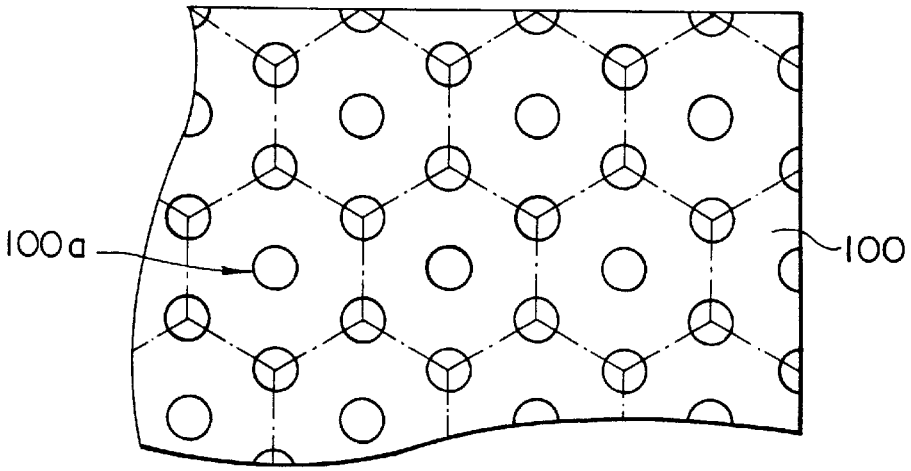
FIG. 9 is a fragmentary enlarged view of an experimental print drum used for experiments.

A series of experiments were conducted in order to determine how the density of a printed image varies, with respect to the method which varies the pressure of the press roller 20 and the method which forms the electric field between the roller 20 and the cylinder 2 while varying the above pressure. For the experiments, use was made of a stencil printer PRIPORT VT3820 (trade name and available from Ricoh Co., Ltd.) of the type adjusting the density by controlling the pressure of the roller 20. An experimental cylinder and an experimental press roller were mounted to the above stencil printer. As shown in FIG. 9, the experimental cylinder, labeled 100, is implemented by a 0.1 mm thick metal sheet formed with a number of pores 100*a* having a diameter of 0.12 mm. The pores 100*a* are arranged in a hexagonal pattern such that the nearby pores 100*a* are spaced 0.3 mm from each other. Two screen layers are laminated on the outer periphery of the cylinder 100. The experimental press roller has a rubber portion formed of NBR of medium electric resistance and in which carbon is dispersed, although not shown. NBR has a hardness of 30 to 40 degrees as prescribed by JIS (Japanese Industrial Standards) A, and a volume resistivity of $10^7$ Ωcm to $10^9$ Ωcm. Further the rubber portion is covered with a thin insulating layer for the double protection of the press roller from shorting.

To implement a stencil printer of the type forming an electric field between the cylinder 100 and the press roller, a power source for applying a constant voltage to the press roller was also added to the above stencil printer. The power source outputs a DC voltage of 2 kV when the press roller presses the cylinder 100. For the experiments, the cylinder 100 is also connected to ground. For both of the two different configurations, use was made of emulsion ink VT1000II (trade name and available from Ricoh Co., Ltd.) in which several percent of carbon was dispersed.

Figure 10A:
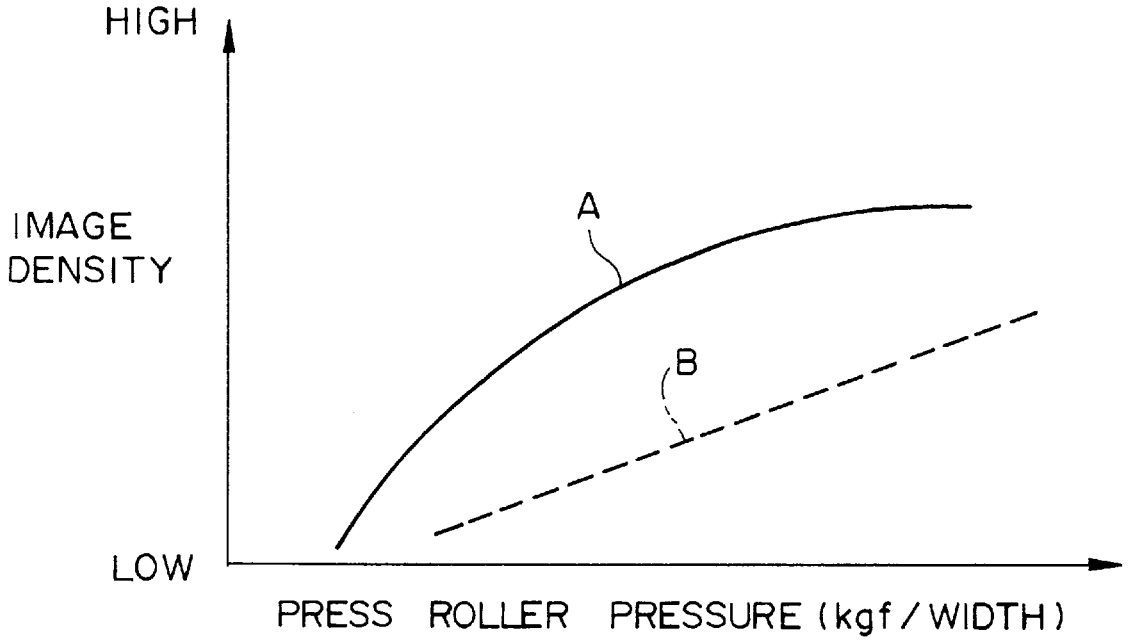
FIG. 10A shows how image density varies when the pressure of the press roller is varied, and when an electric field is formed between the press roller and the print drum.

FIG. 10 shows how image density varied in accordance with the pressure of the experimental press roller. In FIG. 10, the abscissa and ordinate respectively indicate the pressure of the roller and image density. Curves A and B respectively show a case wherein the electric field was formed and a case wherein it was not formed. As FIG. 10A indicates, when the electric field is absent, image density increases substantially in proportion to the pressure of the press roller. By contrast, when the electric field is present, image density is high even when the pressure of the press roller is low; further, image density sequentially increases with an increase in the pressure of the press roller.

The experiments showed that the electric field separates, if not fully, the emulsion ink into a water layer and an oil layer, and that such separation obviates the transfer of the ink to the rear of the next paper, i.e., so-called offset. Specifically, assume that the electric field acts in the direction in which the oil layer with a pigment dispersed therein gathers more on the paper side than on the cylinder side. Then, when the paper and cylinder are separated from each other, the oil layer and water layer respectively concentrate on the press roller side and the cylinder side of the paper. Because such a water layer migrates toward the outermost portion of the printing surface, it prevents the pigment-containing oil layer from being transferred to the rear of the next paper.

Figure 10B:
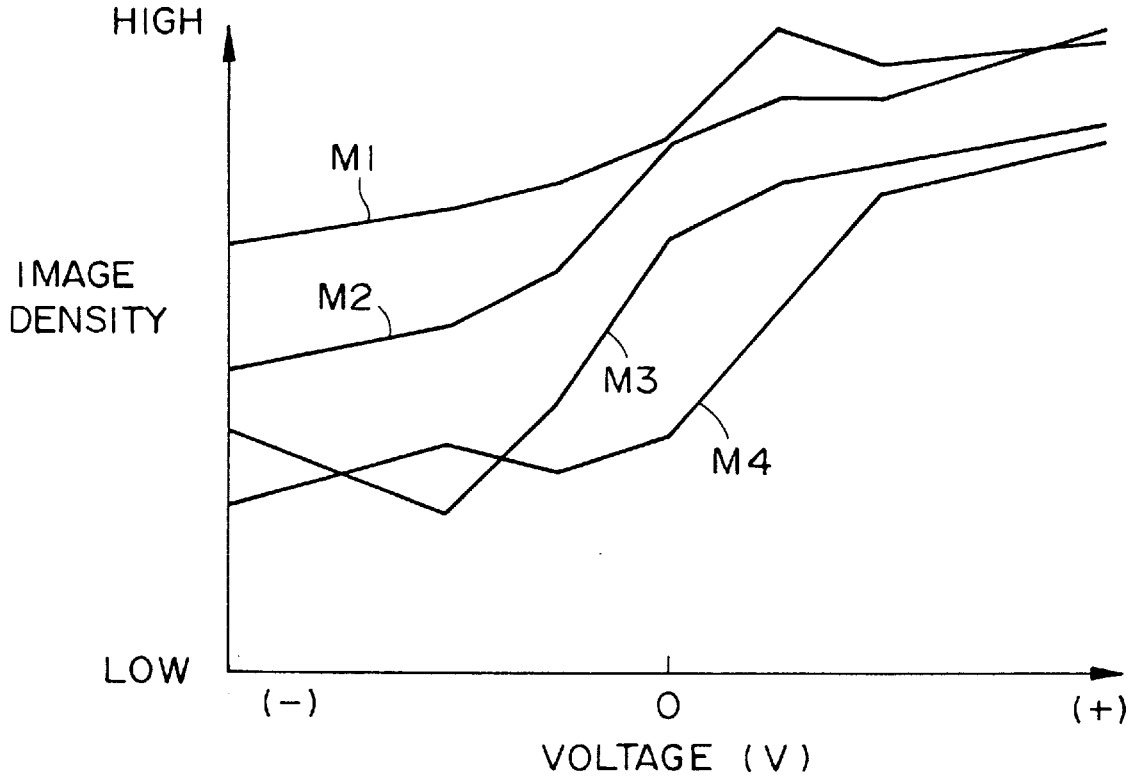
FIG. 10B shows how image density varies when the pressure of the press roller and print speed are varied.

FIG. 10B shows a relation between the image density and the voltage for forming the electric field with respect to the increase and decrease in the pressure of the press roller (print pressure) and print speed. In FIG. 10B, the abscissa and ordinate indicate the voltage and image density, respectively. A curve M1 shows how image density varies under a low print speed, high print pressure condition. A curve M2 shows the variation of image density determined under a high print speed, high print pressure condition. A curve M3 shows the variation of image density determined under a low print speed, low print pressure condition. Further, a curve M4 shows the variation of image density determined under a high print speed, high print pressure condition. As FIG. 10B indicates, image density is adjustable on the basis of the voltage without regard to the print pressure or the print speed, although it slightly varies. It follows that when the print pressure is increased or decreased, the variation of image density ascribable to a change in print speed can be reduced on the basis of the voltage.

The dependency of image density on the voltage, i.e, the variation of image density was determined by varying the rigidity of the cylinder 100. It was found that image density depends more on the voltage when the rigidity of the cylinder 100 is low, i.e., when the cylinder 100 is soft. This is presumably because the electric attraction derived from the electric field causes the cylinder 100 to deform and allows the paper to be held between the ink layer and the press roller 20 for a longer period of time. Therefore, a soft cylinder reduces the pressure to act on the master and allows a number of printings to be produced without damaging the master. As a result, the printing cost is reduced, and high printing quality is insured even when a number of printings are continuously produced.

For the experiments, two screen layers were wrapped around the cylinder 100, as stated earlier. However, so long as the pores 100*a* of the cylinder 100 have a small diameter and a small distance, the screen layers may be omitted because the ink will be sufficiently scattered by the fibrous layer of the stencil. The rubber portion of the experimental press roller may be formed of urethane rubber or similar conductive rubber, or silicone rubber provided with conductivity by carbon, metal powder, titanium oxide, 4,3 iron oxide, conductive ferrite or similar conductive metal oxide. Even with such a rubber portion, the previously stated experimental results are achievable when the electric field is formed between the press roller and the cylinder 100.

Figure 11:
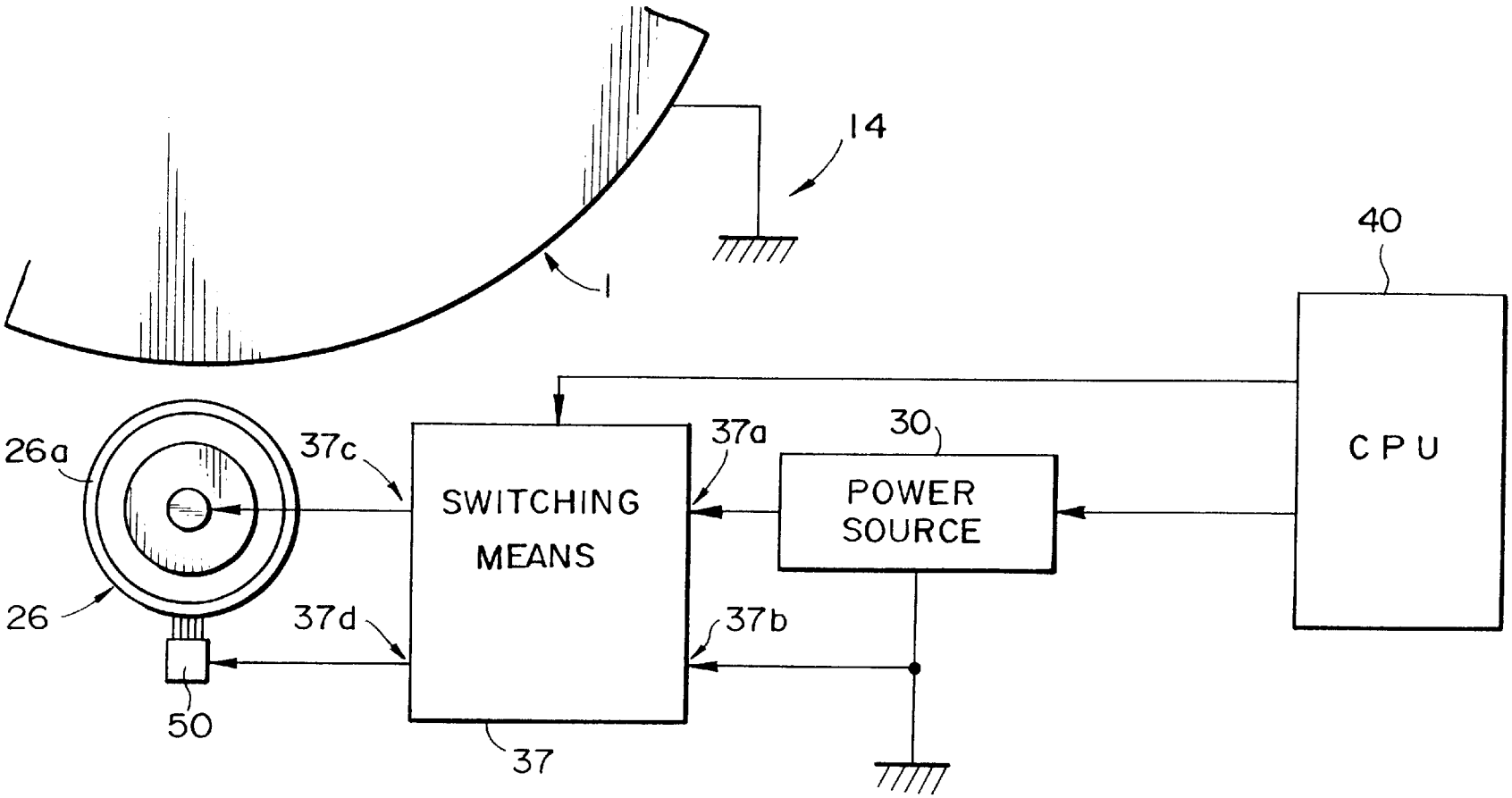
FIG. 11 shows a second embodiment of the present invention.

Referring to FIG. 11, a second embodiment of the present invention will be described. In FIG. 11, the same or similar structural elements as or to the elements shown in FIG. 1 are designated by identical reference numerals, and a detailed description thereof will not be made in order to avoid redundancy. As shown, a conductive discharge brush or discharging member 50 adjoins a press roller 26 in order to discharge the roller 26. While the end of the brush 50 is shown as contacting the press roller 26, it may be spaced from the roller 26 by a suitable distance, if desired.

A 20 μm to 100 μm thick insulating layer 26*a* is formed on the surface of the press roller 26. The insulating layer 26*a* is formed of a fluorine-based or an epoxy-based paint, e.g., LUMIFRON 602 (trade name and available from Asahi Chemical Industry Co., Ltd). Alternatively, the insulating layer 26*a* may be implemented by a commercially available thermally shrinkable tube formed of an insulating material. The first embodiment obviates shorting and discharge, relying on the insulating property of the paper. By contrast, in this embodiment, the insulating layer 26*a* of the press roller 26 obviates shorting and discharge, i.e., the shut-off of the power source more positively, and allows a stable electric field to be formed between the roller 26 and the cylinder 2. Therefore, a higher voltage can be applied to the press roller 26 than to a press roller lacking the insulating layer 26*a,* increasing the electric attraction and therefore the amount of ink transfer. Further, a film or a thin tube covering the surface of the press roller 26 would broaden the range of materials available for the elastic portion of the roller 26. When such a film or the like is absent on the press roller 26, there cannot be used a material not resistant to oil, sponge or similar material elastic, but having an extremely irregular surface, or a material containing a softening agent which would contaminate papers and stencil. The press roller 26 with such a film or the like can have its elastic portion formed of even the above materials, e.g., sponge having low resistance and hardness. A decrease in resistance translates into an increase in the transitional response of the system while a decrease in hardness allows a nip width to be increased. Therefore, the decrease in resistance and the decrease in hardness both promote the high speed operation of the printer.

Switching means 37 having input terminals 37*a* and 37*b* and output terminals 37*c* and 37*d* is connected between the press roller 26 and the power source 30. The CPU 40 causes the switching means 37 to switch the connection of its terminals at the time for forming the electric field and at the time for discharging the press roller 26. Specifically, the power source 30 is connected to the input terminal 37*a* while the input terminal 37*b* is connected to ground. The output terminals 37*c* and 37*d* are connected to the press roller 26 and discharge brush 50, respectively. The power source 30, switching means 37 and CPU 40 constitute discharging means.

Figure 12:
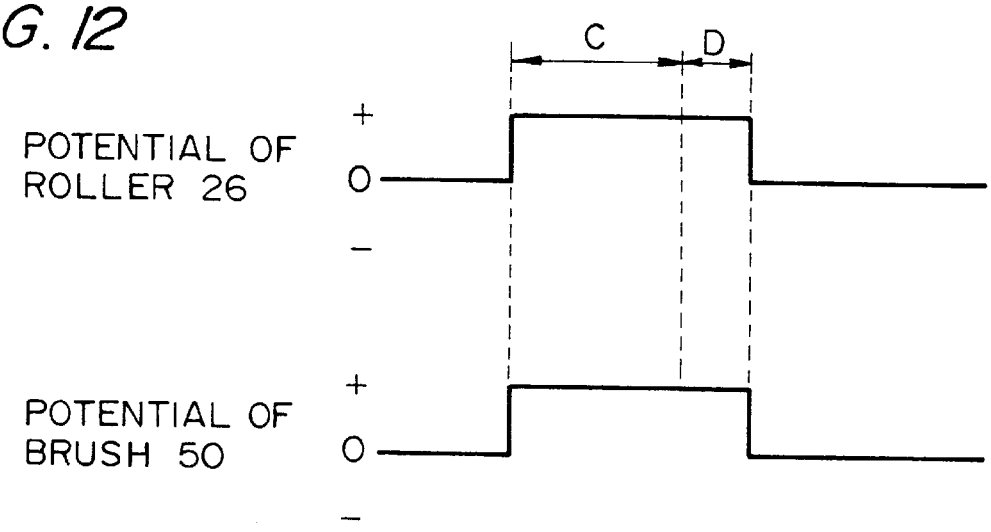
FIG. 12 shows how the potential of the press roller and that of a discharge brush are varied when the electric field is formed and when the press roller is discharged.

FIG. 12 shows a potential deposited on the press roller 26 for forming the electric field, and a potential deposited on the discharge brush 50 for discharging the roller 26. How the brush 50 discharges the roller 26 will be described. The CPU 40 connects the power source 30 to the roller 26 and brush 50, i.e., causes the switching means 37 to connect the input terminal 37*a* to the output terminals 37*c* and 37*d*. When the press roller 26 presses the paper against the drum 1, the CPU 40 sends a voltage application command to the power source 30. In response, the power source 30 applies the high voltage to the roller 26 and brush 50 for a duration C shown in FIG. 12. As a result, the electric field for transferring the ink from the inside of the drum 1 to the paper is formed between the drum 1 and the press roller 26. At this instant, charge opposite in polarity to the charge generated in the roller 26 migrates from the drum 1 to the surface of the roller 26.

Subsequently, the CPU 40 releases the roller 26 from the drum 1 and causes the roller 26 to rotate via drive means, not shown. Therefore, the brush 50 cleans the surface of the roller 26 in rotation. During this period of time (D, FIG. 12), the CPU 40 continues the application of the voltage to the roller 26 and brush 50. As a result, the charge deposited on the roller 26 is neutralized by charge fed from the brush 50. After the roller 26 has completed one rotation, the CPU 40 stops sending the voltage application command meant for the roller 26. Consequently, the deposition of charge on the roller 26 is prevented while the surface of the roller 26 is cleaned by the brush 50. This prevents paper and dust from adhering to the surface of the roller 26.

At the time of discharge, the roller 26 and brush 50 may be disconnected from the power source 30 and connected to ground, if desired. This also successfully neutralizes the charge deposited on the roller 26.

Figure 13:
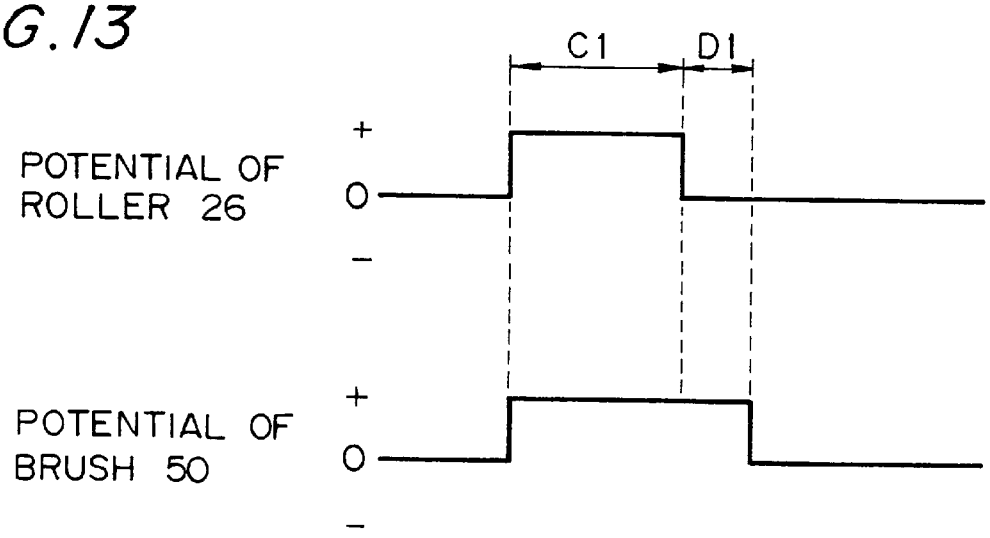
FIGS. 13 and 14 are views similar to FIG. 12, each showing a particular modification of the second embodiment.

In a modification of the second embodiment, at the time of discharge, the CPU 40 disconnects the roller 26 from the power source 30 and connects it to ground while holding the brush 50 in connection with the power source 30. In this condition, the voltage applied to the brush 50 forms an electric field between the roller 26 and the brush 50, drawing out the charge deposited on the roller 26. In this case, the potentials deposited on the roller 26 and brush 50 vary as shown in FIG. 13. As shown, the electric field is formed over a duration C1 while the discharge is effected over a duration D1. This kind of configuration allows the brush 50 to discharge the roller 26 more efficiently than the configuration of the second embodiment.

Figure 14:
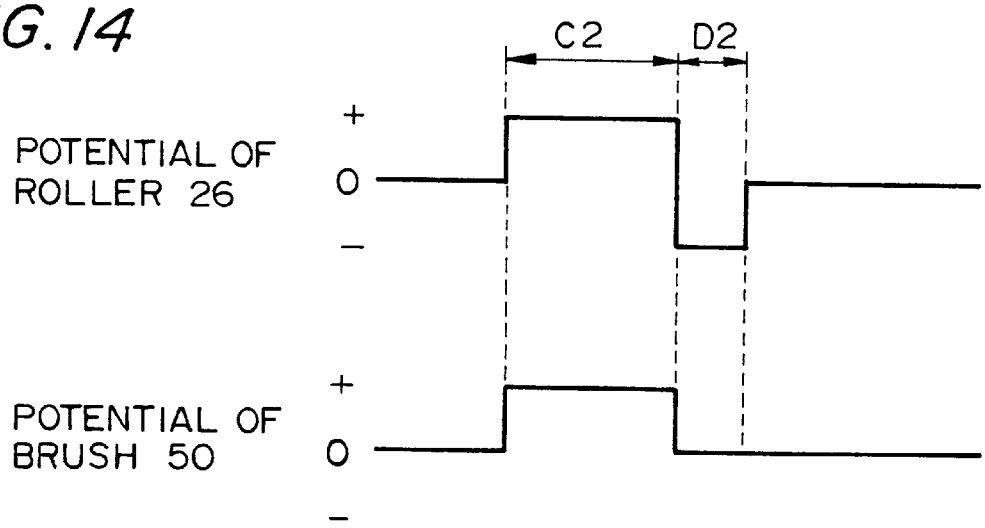

In another modification of the second embodiment, an electric field opposite in polarity to the electric field between the drum 1 and the roller 26 is formed between the roller 26 and the brush 50 in order to discharge the roller 26. In this modification, a power source capable of switching the polarity of its output voltage is substituted for the power source 30. How the brush 50 discharges the roller 26 will be described with reference to FIG. 14.

At the time for forming the electric field, the switching means 37 switches the connection of its terminals in the same manner as in the second embodiment. Subsequently, the high voltage is applied to the roller 26 and brush 50 for a duration C2 shown in FIG. 14, forming an electric field for transferring the ink from the drum 1 to the paper. Thereafter, to discharge the roller 26, the switching means 37 disconnects the brush 50 from the power source and connects it to ground while holding the roller 26 in connection with the power source. At this instant, the power source reverses the polarity of its output voltage being applied to the roller 26, as indicated by D2 in FIG. 14. As a result, an electric field opposite in polarity to the electric field used for the ink transfer is formed between the roller 26 and the brush 50, drawing out the charge deposited on the roller 26. This modification therefore allows the brush 50 to discharge the roller 26 more efficiently than the second embodiment.

In the second embodiment and its modifications, many of the insulating materials applicable to the insulating layer 26*a* are hard. Stated another way, when the insulating layer 26*a* should be provided with elasticity, the range of insulating materials available is limited. In light of this, the specific resistance of the insulating layer 26*a* may be lowered to a medium resistance. Materials having a medium resistance are elastic, low cost, and easy to obtain. To form a medium resistance layer, about 5 wt % of carbon may be dispersed in LUMIFRON, or the surface of the roller 26 may be covered with urethane or hydrin rubber. The thickness of the insulating layer 26 or that of the medium resistance layer is suitably selected in consideration of the withstanding voltage of the material constituting the roller 26.

The above medium resistance layer is apt to change its electric characteristic due to the migrations of ions in one direction. The second embodiment is free from this problem because it discharges the roller 26 and thereby obviates the migration of the ions in one direction within the medium resistance layer.

In the second embodiment and its modifications, the brush 50 may be replaced with a metallic discharge roller contacting the roller 26 and following the movement of the roller 26. Further, for the power source 30, use may be made of a conventional DC power source whose output voltage is variable, or an AC power source. When a DC power source is used, the output voltage of the power source may be increased at the time of discharge in order to enhance efficient discharge.

On the other hand, when an AC power source is used, its frequency should be high enough to free the printing surface from irregular image density. For example, when the printer used for the previously stated experiments was operated at the maximum print speed of 1,300 mm/sec, and when the AC power source had a frequency of higher than 2.2 kHz inclusive, the irregularity in pitch as measured on the printing surface was as small as 0.3 mm or below. However, even when the frequency of the AC power source is about 500 Hz, the irregularity in pitch ascribable to the frequency is not noticeable for the following reason. The voltage output from the AC power source causes the attraction ascribable to the induction charge and the electric field to vary. The variation of the attraction causes the ink to vibrate and flow actively.

The advantage achievable with the above voltage is that the amount of ink transfer to the paper can be controlled, rather than that the irregular pitch on the printing surface can be reduced. Particularly, when the voltage is higher than a certain value, the property determined by the charge induced by the electric field influences more than the electric property of the ink (to which polarity the coloring component is attracted more), rendering the polarity dependency indefinite. Therefore, the irregularity on the printing surface and ascribable to the voltage is observed when the voltage is low, but becomes negligible when the voltage is high (only an increase in the average amount of ink transfer is observed).

The ink becomes more fluid and more attracted by the paper when the image is a dot image, line image or similar image in which electric lines of force concentrate on narrow portions than when it is a solid image or similar parallel flat electric field pattern. This is the phenomenon referred to as the concentration of electric field or the edge effect in, e.g., the electrophotographic art. Experiments relating to the present invention also showed that with a halftone image implemented by dots, the amount of ink consumption and image density vary in accordance with the voltage. Specifically, the ink consumption and image density both increase when the voltage is high, but decrease when the voltage is low. Further, the variation of ink consumption and image density is more noticeable with a halftone image than with a solid image.

The human visual sense is more sensitive to the variation of image density in a low density portion than to the variation of the same in a high density portion. Therefore, for a given width of variation, a person feels the variation more in a low density portion than in a high density portion. It follows that when a halftone image or similar low density image is to be printed, it is possible to adjust the density and thereby stabilize the image by controlling the above voltage.

Assume that a color image in the form of a dot pattern is printed on a paper by a plurality of print drums. Then, the above broad range of density control allows the density to be adjusted over a broad range color by color. Specifically, when the print pressure is varied in order to adjust the density over a broad range, it is likely that the degree of fatigue differs from a master assigned to one color to a master assigned to another color, resulting in irregularity in color. By contrast, the density control using the voltage reduces the irregularity in the fatigue of the master including stretching, and thereby reduces the irregularity in the color of a printing. It is to be noted that although the density control using the voltage increases the ink transfer at the positions corresponding to the pores of the cylinder, this can be coped with by increasing the density of the pores of the cylinder, as stated earlier.

Other advantages achievable with the AC power source are as follows. Because the paper and master are charged to one polarity, a minimum of paper dust is allowed to deposit on the paper and master. The paper is prevented from jamming, or rolling up, due to the discharge. This stabilizes the separation of the paper or printing from the drum, the conveyance of the printing, and the positioning of the printing on a stack. Further, because only a minimum of DC component exists, there can be used an integral press roller having its surface insulated or formed of a minimum resistance material, promoting safety operation.

The output voltage of the AC power source may be similarly applied to a prior art method and apparatus for image formation taught in, e.g., Japanese Patent Laid-Open Publication No. 4-59384. In this case, oscillation ascribable to the AC power source allows the ink to easily separate from a transfer member and then infiltrate into a paper or similar recording medium. The infiltration of the ink into the recording medium can be confirmed because the increase in ink transfer at the positions corresponding to the pores of the cylinder, as mentioned above, becomes more noticeable with an increase in AC amplitude. That is, the infiltration (fluidity) of the ink increases with an increase in AC amplitude. This indicates that the amount of flow or transfer of the ink corresponding to portions where a counter electrode is absent increases. Such an occurrence is not shown or described in the above document. Further, the above document teaches that when gas is generated by the electrolysis of ink, the electrolysis facilitates the transfer of the ink to a paper. However, the method or the apparatus disclosed in the document cannot account for the occurrence that the amount of ink transfer increases at portions where an electrode is absent, compared to portions where it is present.

The apparatus taught in the above document applies a voltage by use of a DC power source, and therefore must use a conductive transfer member. The conductive transfer member, however, might cause shorting or similar fault to occur due to the voltage. In the illustrative embodiment, the AC power source reduces the probability of such faults and enhances safety operation.

So long as the electric attraction does not depend on the polarity of the voltage due to the AC power source, it is possible to free the press roller 26 from charging, and therefore to omit the discharging means stated earlier. While some kinds of ink are easily chargeable to one polarity, the charge of the roller 26 can be neutralized only if pulsation with DC of polarity capable of obviating the charge superposed thereon (pulsation power source) is used.

Figure 15:
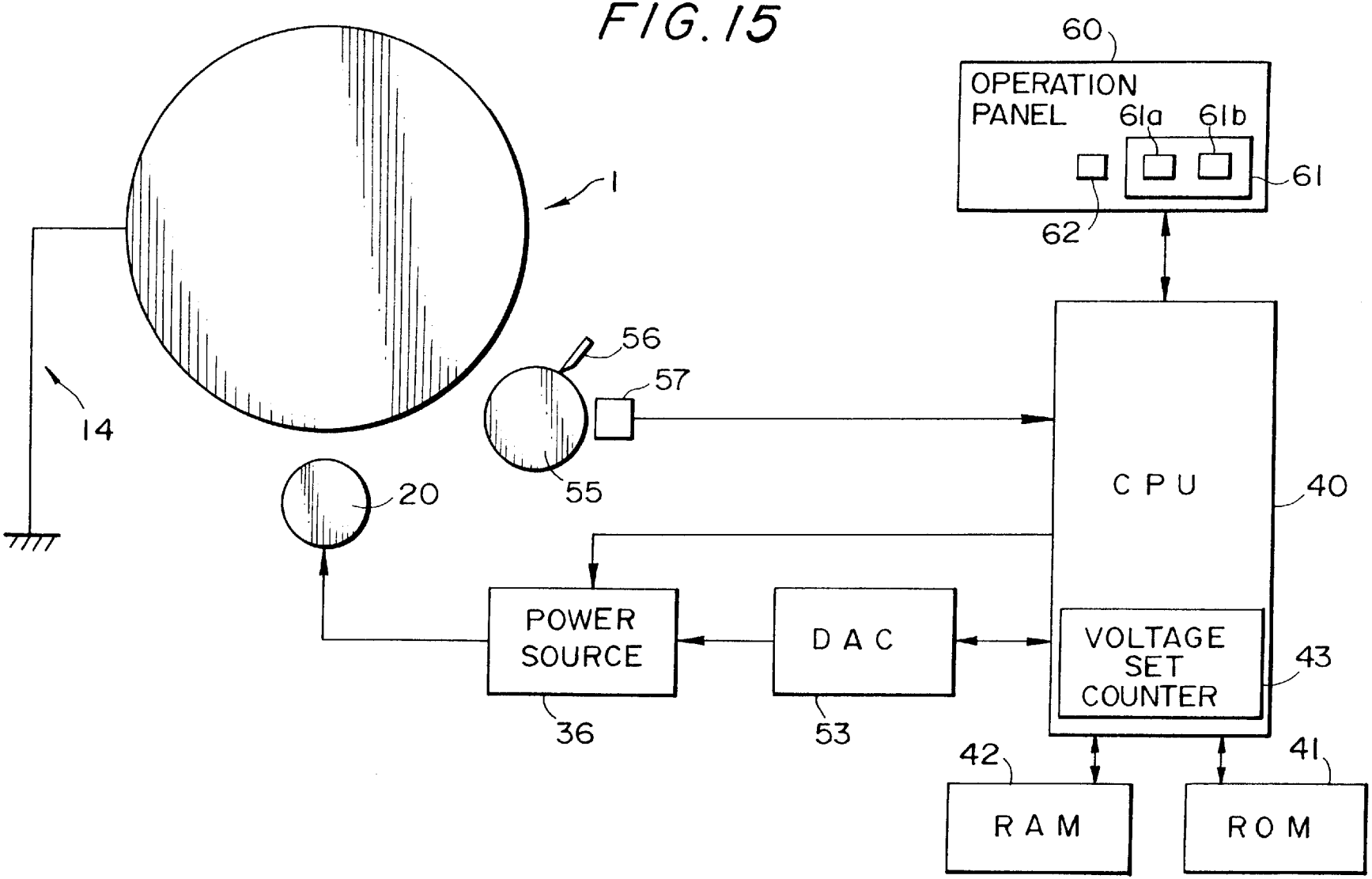
FIG. 15 shows a third embodiment of the present invention.

FIG. 15 shows a third embodiment of the present invention. In FIG. 15, the same or similar structural elements as the elements shown in FIG. 1 are designated by identical reference numerals, and a detailed description thereof will not be made in order to avoid redundancy. As shown, a sensor roller 55 is located upstream of the press roller 20 with respect to the direction in which the drum 1 rotates during printing. The sensor roller 55 is movable into and out of contact with the drum 1 and has a white surface. A particular pattern is formed in the leading edge portion of the master, but outside of the area corresponding to the paper. The particular pattern will be printed on the sensor roller 55, as will be described specifically later. Arranged around the sensor roller 55 are a cleaning blade 56 for cleaning the surface of the roller 55, and an image density sensor or image density sensing means 57 for sensing the density of the pattern printed on the roller 55. The density sensor 57 sends its output or density signal representative of the sensed density of the pattern to the CPU 40. A relation between the density signal output from the sensor 57 and the actual image density to be printed on the paper at the time of density setting is determined beforehand by, e.g., experiments and stored in the ROM 41 as density data.

An operation panel 60 is connected to the CPU 40 and allows various kinds of commands and information to be input thereon. The operation panel 60 is mounted on the printer at an easy-to-access position. Arranged on the panel 60 are a image density adjust key or image density setting means 61 which allows image density to be adjusted by hand, and an image density set key 62 which sets a reference density at the time of automatic density control. The key 61 consists of a density down key 61*a* for lowering image density, and a density up key 61*b* for raising image density. The outputs of the keys 61*a,* 61*b* and 62 are sent to the CPU 40.

The CPU 40 includes a voltage set counter 43 for temporarily storing a voltage to be applied to the press roller 60. The CPU 40 calculates, based on the output of the density up key 61*a* or the density down key 61*b,* a voltage to be applied to the press roller 20 and writes it in the voltage set counter 43. Specifically, the CPU 40 lowers the voltage to be applied to the roller 20 when the down key 61*a* is pressed, or raises it when the up key 61*b* is pressed. When the density set key 62 is pressed, the CPU 40 writes the current reference density in the RAM 42.

A digital-to-analog converter (DAC) 53 is connected between a power source 36 and the CPU 40 in order to convert a digital signal input from the CPU 40 to an analog signal. The analog signal is used as a reference power source for a voltage comparing section included in the power source 36. The output voltage of the power source 36 is varied within an adjustable range by the analog signal.

The adjustment of image density particular to the present invention is as follows. First, the manual adjustment of image density will be described. The printer starts printing a desired image on a paper, as in the first embodiment. If the density of the image printed on the paper is lower than desired one, then the operator presses the density up key 61*b*. In response, the CPU 40 increases the voltage to be applied to the press roller 20 and thereby intensifies the electric field between the press roller 26 and the drum 1. As a result, the amount of ink transfer from the drum 1 to the paper, i.e., image density increases.

If the image density is higher than desired one, the operator presses the density down key 61*a*. In response, the CPU 40 lowers the voltage to be applied to the press roller 20 and therefore the intensity of the electric field between the press roller 20 and the drum 1. As a result, the amount of ink transfer from the drum 1 to the paper, i.e., the image density decreases.

The manual adjustment using the down key 61*a* and up key 61*b* is effected within the adjustable range available with the power source 36. When an image is dark enough to bring about, e.g., offset or disfiguring of characters is desired, the density can be increased on the up key 61*b* within the adjustable range so as to output an extremely dark image. An extremely light image is also achievable within the above adjustable range by using the down key 61*a*.

Automatic density adjustment is also available with the illustrative embodiment, as follows. First, the reference density for automatic adjustment is set by the following procedure. At the time of trial printing, the previously mentioned particular pattern of a master is printed on the sensor roller 55 before a document image is printed on a paper. The density sensor 57 senses the density of the pattern printed on the roller 55. The density signal output from the sensor 57 is input to the CPU 40, as needed. When the operator sees that the density of an image printed at the time of trial printing is satisfactory, the operator presses the density set key 62. In response, the CPU 40 writes the density in the RAM 42 as a reference density.

The trial printing is followed by the continuous printing, as stated earlier. Before an image is printed on a paper, the density signal output from the density sensor 57 and representative of the density of the pattern printed on the sensor roller 55 is again input to the CPU 40. In response, the CPU 40 compares the density of the above pattern with the reference density stored in the RAM 42, and computes a voltage meant for the press roller 20 and which will set up the reference density. Specifically, the CPU 40 feeds a digital signal representative of the computed voltage to the DAC 53. As a result, the voltage to be applied from the power source 36 to the press roller 20 is controlled. Such a control procedure is effected every time a printing operation is desired.

Assume that the operator presses the down key 61*a* or the up key 61*b* while the automatic density adjustment is under way. Then, the CPU 40 interrupts the automatic adjustment and gives priority to the manual adjustment. On the transition from the automatic adjustment to the manual adjustment, it is necessary to prevent the density from sharply changing. For this purpose, the reference density set for the automatic adjustment is handed over and used as the initial density for the manual adjustment. Again, the automatic adjustment is effected within the adjustable voltage range available with the power source 36.

Figure 16:
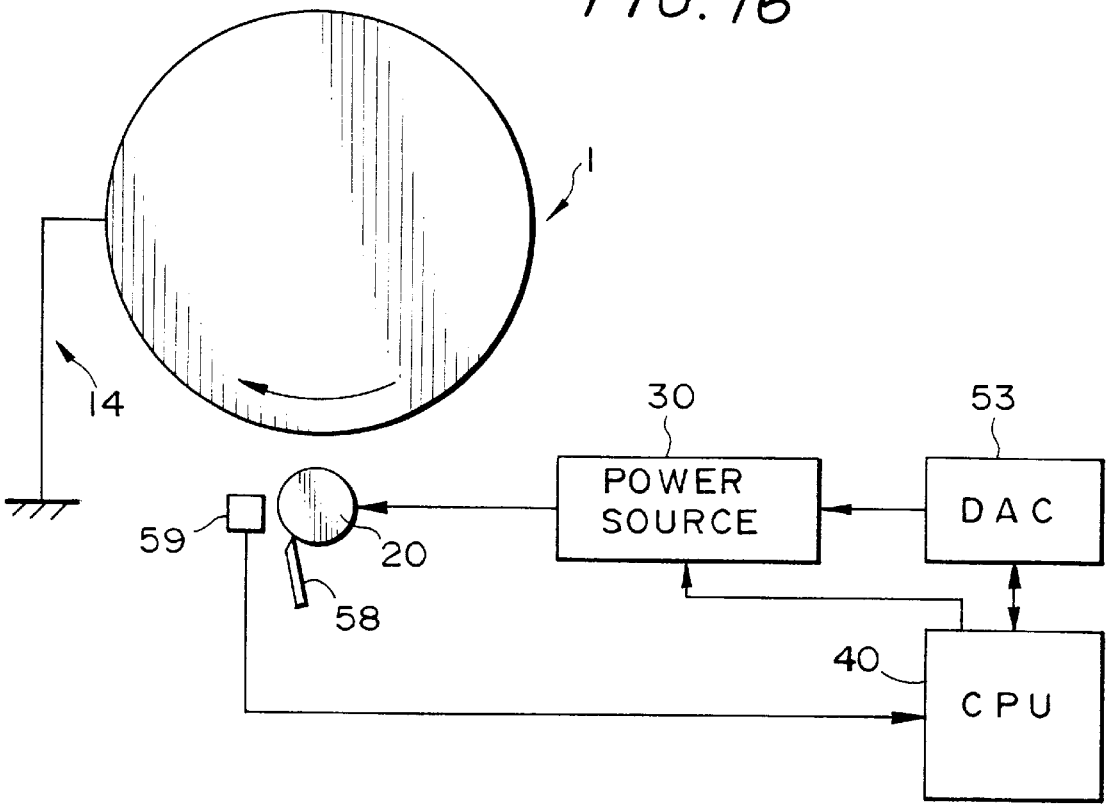
FIGS. 16 and 17 each shows a particular modification of the third embodiment.

FIG. 16 shows a modification of the above image density sensing means and using the the press roller 20. As shown, the press roller 20 plays the role of the sensor roller 55 at the same time. In the modification, the surface of the roller 20 is covered with a white material. Arranged around the roller 20 are a cleaning blade 58 for cleaning the surface of the roller 20, and a density sensor or image density sensing means 59 responsive to the density of the particular pattern which will, in this case, be printed on the roller 20. A density signal output from the sensor 59 is sent to the CPU 40.

Figure 17:
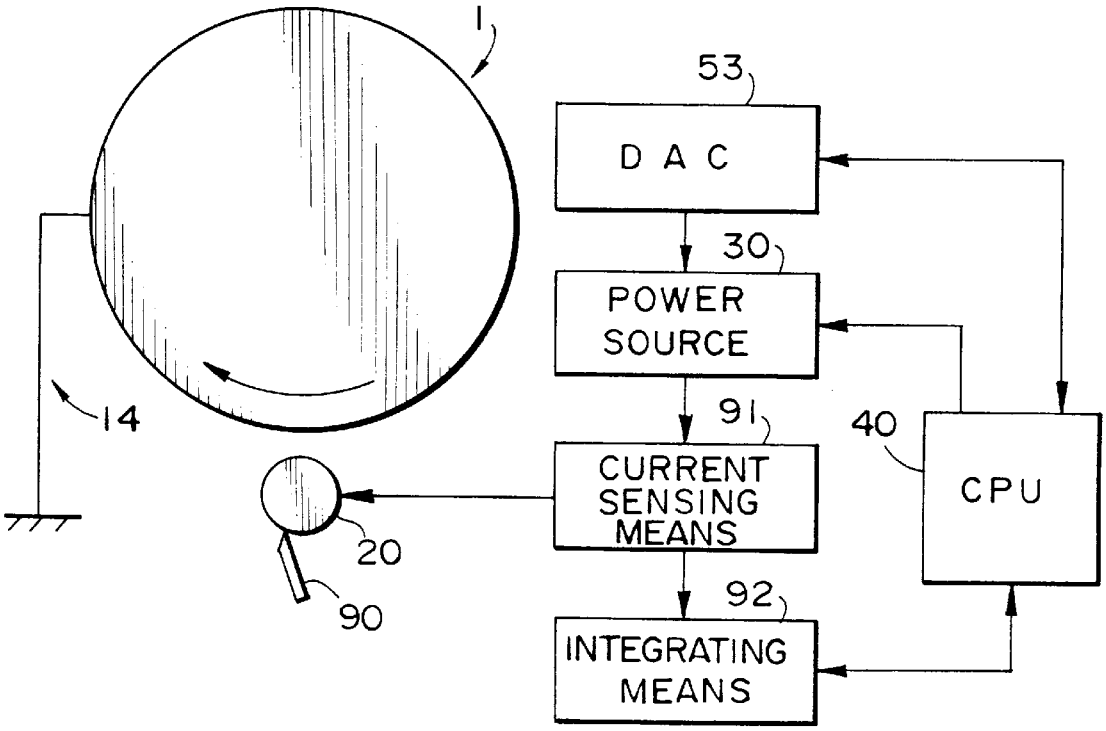

FIG. 17 shows another modification of the image density sensing means. As shown, a cleaning blade 90 is so positioned as to clean the surface of the press roller 20. Current sensing means 91 is connected between the press roller 20 and the power source 30 in order to sense a current flowing to the roller 20. Integrating means 92 is connected to the current sensing means 91 in order to integrate the current flowing to the roller 20. The integrating means 92 is also connected to the CPU 40 and sends its output thereto. The CPU 40 delivers a reset signal to the integrating means 92 for resetting it.

The current sensing means 91 senses a current flowing to the roller 20 when the particular pattern is printed on the roller 20. The integrating means 92 integrates the current sensed by the current sensing means 91 and thereby calculates the amount of ink to be transferred from the drum 1 to the roller 20. The density of the image printed on the roller 20 is produced from such an amount of ink transfer. In this sense, the current sensing means 91 and integrating means 92 constitute image density sensing means.

Figure 18:
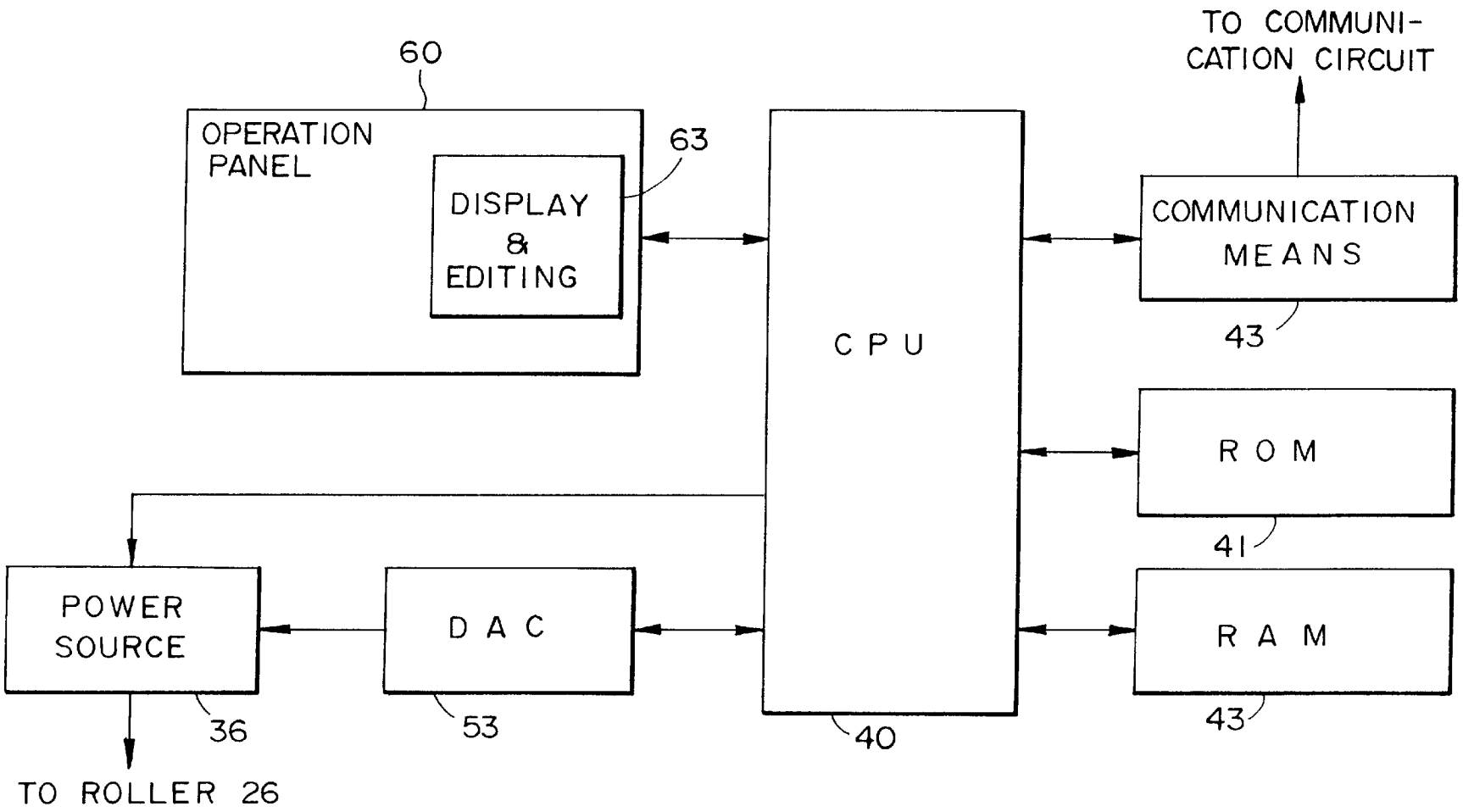
FIG. 18 shows a fourth embodiment of the present invention.

A fourth embodiment of the present invention will be described with reference to FIG. 18. In FIG. 18, the same or similar structural elements as or to the elements shown in FIG. 15 are designated by identical reference numerals, and a detailed description thereof will not be made in order to avoid redundancy. In this embodiment, the ROM 41 stores voltage adjustable ranges and reference voltages each assigned to a particular kind of ink. Each voltage adjustable range determines a particular range of image density control while each reference voltage provides an image with a particular standard density. The voltage adjustable range and reference voltage selectively read out of the ROM 41 are written to the RAM 42. A back-up battery is associated with the RAM 42 for preventing the data stored in the RAM 42 from disappearing when a power switch provided on the printer is turned off. Specifically, once the data are written to the RAM 42, they are held unless the RAM 42 receives a reset signal from the outside of the printer. Therefore, the data existing in the RAM 42 are used for the next printing operation.

The operation panel 60 includes a display and editing, or ink designating means, 63 which is accessible for the operator to select desired one of a plurality of kinds of ink stored in the RAM 42, and to display and edit the data relating to the ink, as desired. The display and editing 63 includes various kinds of keys, not shown, allowing the operator to add a desired kind of ink to the RAM 42, to delete a desired kind of ink stored in the RAM 42, and to edit the voltage adjustable ranges and reference voltages.

Communicating means 43 is also connected to the CPU 40 to implement data communication between the printer and a remote station via a telephone circuit. With the communicating means 43, it is possible to update the data stored in the RAM 42 at a remote station, and to effect remote diagnosis for the immediate detection of errors.

A procedure for editing, or updating, the data stored in the RAM 42 will be described. When the power switch of the printer is turned on, the CPU 40 reads data stored in the ROM 41 and RAM 42. If no data are present in the RAM 42, data present in the ROM 41 are automatically written to the RAM 42 and displayed on the display and editing 63. If data are present in the RAM 42, they are displayed on the display and editing 63. In this condition, the operator may manipulate the edit keys of the display and editing 63 for selecting the ink stored in the printer, i.e., the ink to be used and/or for editing the ink data in accordance with desired printing conditions. The edited ink data are again written to the RAM 42. This is followed by the printing operation stated previously.

Figure 19:
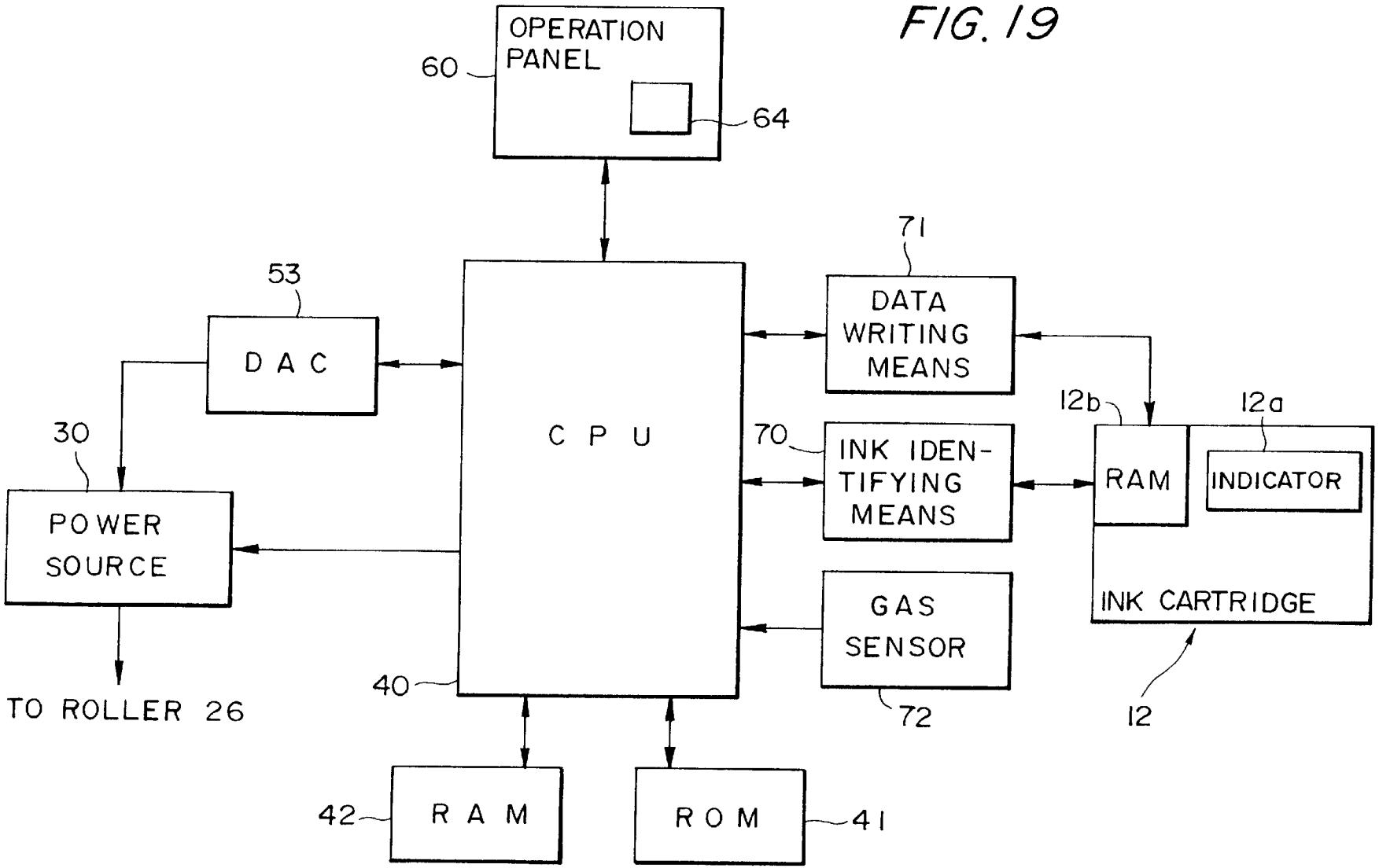
FIG. 19 shows a fifth embodiment of the present invention.

Reference will be made to FIG. 19 for describing a fifth embodiment of the present invention. In FIG. 19, the same or similar structural elements as the elements shown in FIG. 15 are designated by identical reference numerals, and a detailed description thereof will not be made in order to avoid redundancy. As shown, a RAM or storing means 12*b* stores data relating to the ink, e.g., the kind of the ink and the date of production. The RAM 12*b* is mounted on the ink cartridge 12, FIG. 2, and backed up by a battery, not shown. An indicator 12*a* for displaying the condition of storage of the ink is provided on the ink cartridge 12. A thermosensitive paint is applied to the indicator 12*a* and changes its color when the emulsion ink is brought out of its recommended storage temperature. This is because the characteristic of emulsion ink noticeably varies, depending on the storage temperature. The operator can determine the storage condition of the ink stored in the cartridge 12 before mounting it to the printer. This prevents ink whose characteristic has been deteriorated from being used.

Ink identifying means 70 and a gas sensor or ignitability determining means 72 are connected to the CPU 40. The ink identifying means 70 reads data stored in the cartridge 12 while the gas sensor 72 determines the degree of ignitability of the ink stored in the cartridge 12. The ink identifying means 70 is located in the vicinity of the cartridge 12 and sends the data read out of the RAM 12*b* to the CPU 40. The gas sensor 72 is disposed in the conduit 13, FIG. 2, and senses the density of ignitable gas derived from the evaporation of the ink in the cartridge 12. Data writing means 71 is also positioned in the vicinity of the cartridge 12 for writing in the RAM 12*b* how long the cartridge 12 has been set in the printer, how many printings have been produced with the cartridge 12, and the temperature inside the printer. The data written to the RAM 12*b* by the data writing means 71 show, e.g., the condition of storage of the ink and facilitate error diagnosis.

The ROM 41 connected to the CPU 40 stores, in addition to the voltage adjustable ranges and reference voltages stated earlier, correction data for correcting the above ranges and reference voltages in accordance with the aging of the ink.

The CPU 40 sets an adequate voltage adjustable range and an adequate reference voltage, as follows. First, the operator selects an ink cartridge 12 that has been stored and used only within its recommended temperature range and mounts ink cartridge 12 to the printer. Then, the ink identifying means 70 reads out of the RAM 12*b* of the cartridge 12 the kind of ink, the date of production and other data relating to the ink, the period of time for which the cartridge 12 was mounted on the printer last time, the number of printings produced during the above period of time, and other data relating to the use of the cartridge 12. Such data are sent from the identifying means 70 to the CPU 40.

In response, the CPU 40 compares the period of time of the last mounting and the number of printings produced during the period of time so as to determine whether or not the ink in the cartridge 12 is in a defective condition. The defective condition refers to, e.g., the expiration of the term of guarantee or the trace of ink replenishment effected midway due to the desired number of printings. If the cartridge 12 is not defective, the CPU 40 computes the time elapsed since the production of the ink on the basis of the date of production and the current date available within the CPU 40. Subsequently, the CPU 40 selects, among the voltage adjustable ranges and reference potentials each assigned to a particular kind of ink, the adjustable range and reference voltage matching the ink of the cartridge 12. At the same time, the CPU 40 reads the correction data corresponding to the elapsed time out of the ROM 41, and corrects the adjustable voltage range and reference voltage therewith. Thereafter, the CPU 40 adjusts the voltage to be applied to the press roller 20 on the basis of the corrected adjustable range and corrected reference voltage.

As stated above, the CPU 40 automatically detects ink adequate for printing and selects a voltage adjustable range and a reference voltage assigned to the ink. This kind of automatic procedure frees the operator from erroneous operation and from heavy load. In this manner, a voltage adjustable range and a reference voltage optimal for the ink to be used are set up automatically.

When the ink of the cartridge 12 mounted to the printer is defective, the CPU 40 turns on an alarm lamp 64 provided on the operation panel 60 so as to urge the operator to replace the cartridge 12. At the same time, the CPU 40 inhibits the ink from being fed from the cartridge 12 to the ink pipe 7, FIG. 2.

The CPU 40 determines that the ink of the cartridge 12 is defective when, e.g., any one of the following conditions occurs:

1. The ink identifying means 70 cannot read the data relating to the ink out of the RAM 12*b* when the cartridge 12 is mounted to the printer;

2. The CPU 40 determines that the usable term of the ink has expired; and

3. The gas sensor 72 determines that the gas produced from the ink is ignitable. To determine the degree of ignitability of the gas, the gas sensor 72 senses the density of the ignitable gas when the cartridge 12 is mounted to the printer. Then, the sensor 72 compares the sensed density and a reference density liable to ignite the gas due to a spark when the high voltage for forming the electric field is applied to the press roller 20. When the sensed density is higher than the reference density, the sensor 72 determines that the gas is ignitable.

When ink whose term of guarantee has expired, whose kind cannot be identified or which is apt to ignite is mounted to the printer, the illustrative embodiment inhibits the ink from being used. In addition, when the cartridge 12 is reused with ignitable ink filled therein by accident, the embodiment prevents the ink from being used.

Of course, the RAM or storing means 12*b* storing the various data relating to the ink may be replaced with a bar code, hologram pattern, magnetic pattern, electrical contact, color code, or projection or recess. If the detection of the kind of ink alone suffices, ink hue detecting means, impedance measuring means or similar means responsive to the kind of ink may be disposed in the conduit 13, FIG. 2. Further, a ROM storing the data relating to the ink may be built in the cartridge 12.

The correction data for the adjustable voltage ranges and reference voltages stored in the ROM 41 may alternatively be stored in the RAM 12*b* or a ROM built in the cartridge 12. In such an alternative case, the CPU 40 will compute the time elapsed since the date of production of the ink, and then read the correction data matching the elapsed time out of the RAM 12*b* or the ROM via the ink identifying means 70.

A sixth embodiment of the present invention will be described hereinafter. Briefly, when some local defect occurs in the printer, the sixth embodiment detects the local defect before it turns out a serious trouble. In the following description, the local defect is assumed to be a pin hole or holes formed in the insulating layer of the press roller by way of example.

Assume that in the printer of the type applying the high voltage to the press roller whose surface is covered with the insulating layer, as stated above, a pin hole is formed in the insulating layer. Then, when the power source is implemented as a constant voltage power source, the current increases in synchronism with the rotation of the press roller; when use is made of a constant current power source, the voltage drops in synchronism with the rotation of the roller. This phenomenon occurs at a stage where a fault which would disable the printer is about to occur. Therefore, by detecting such a phenomenon and stopping the operation of the printer, it is possible to obviate the fault which would disable the printer.

Figure 20:
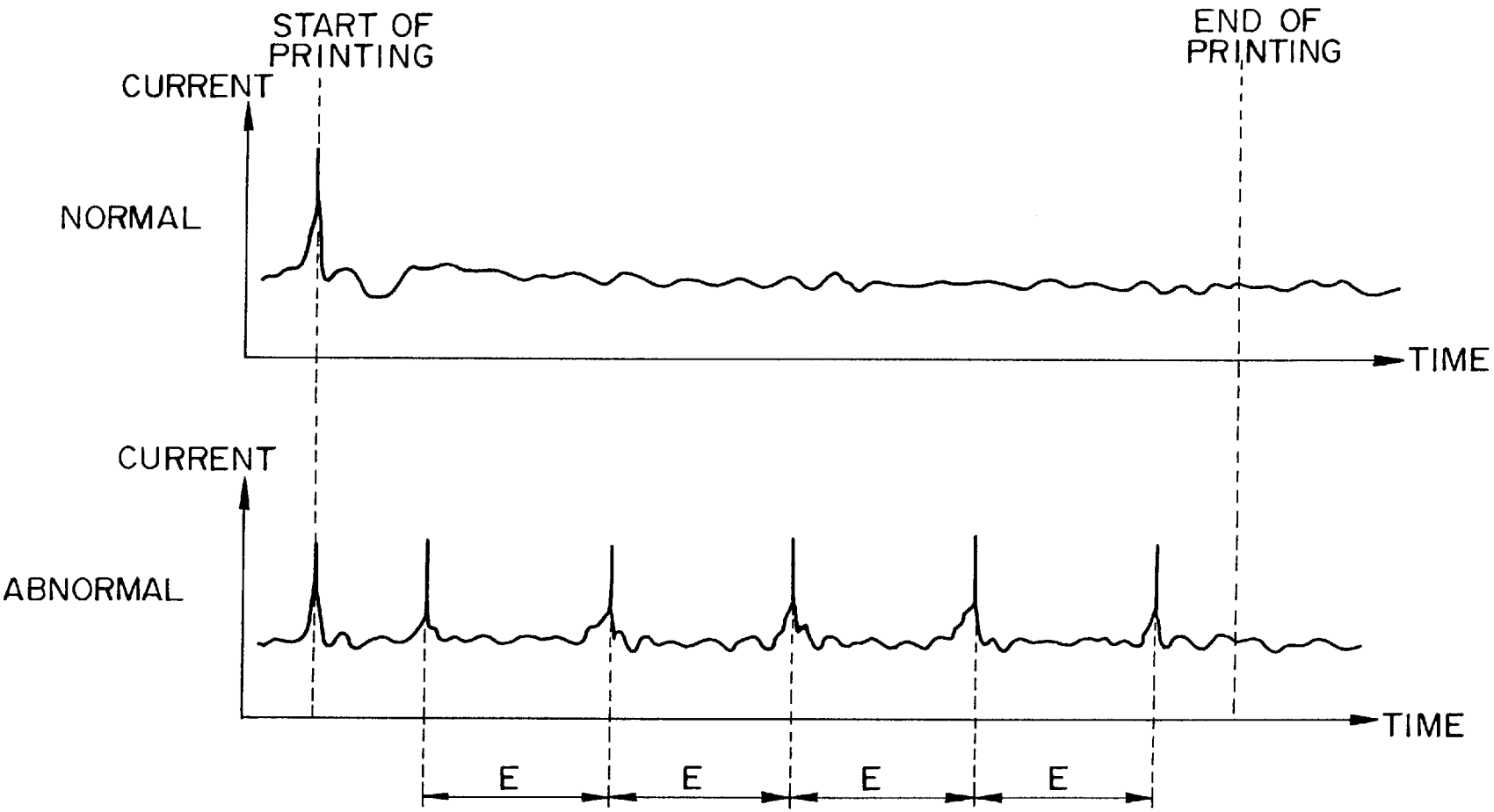
FIG. 20 compares current variations to occur when the press roller is free from defects and when it is defective with respect to a constant voltage power source.

Reference will be made to FIG. 20 for comparing, with respect to the variation of a current output from a constant voltage power source, the case wherein the press roller is normal and the case wherein it is abnormal (due to a single pin hole formed therein). FIG. 20 shows a specific condition wherein a single printing is produced. Labeled E is a period of time necessary for the press roller to complete one rotation.

While the press roller is normal, a great current momentarily flows to the press roller at the start of printing for forming the electric field, but it is immediately replaced with a substantially constant current. The constant current continuously appears up to the end of printing. By contrast, assume that a single pin hole is formed in the press roller, as mentioned above. Then, after the great current has flown to the press roller at the start of printing, a great current flows to the roller every time the roller makes one rotation, i.e., every time the pin hole is pressed against the cylinder of the print drum. This continues up to the end of printing. Therefore, when the press roller is abnormal, a great current flows to the press roller either periodically or continuously, depending on the number of pin holes.

To determine whether or not the press roller is abnormal on the basis of the above occurrence, the sixth embodiment includes current sensing means for sensing the amount of current flowing to the press roller, and decision means for determining, based on the amount of current sensed, whether or not the press roller is defective, as follows.

Figure 21:
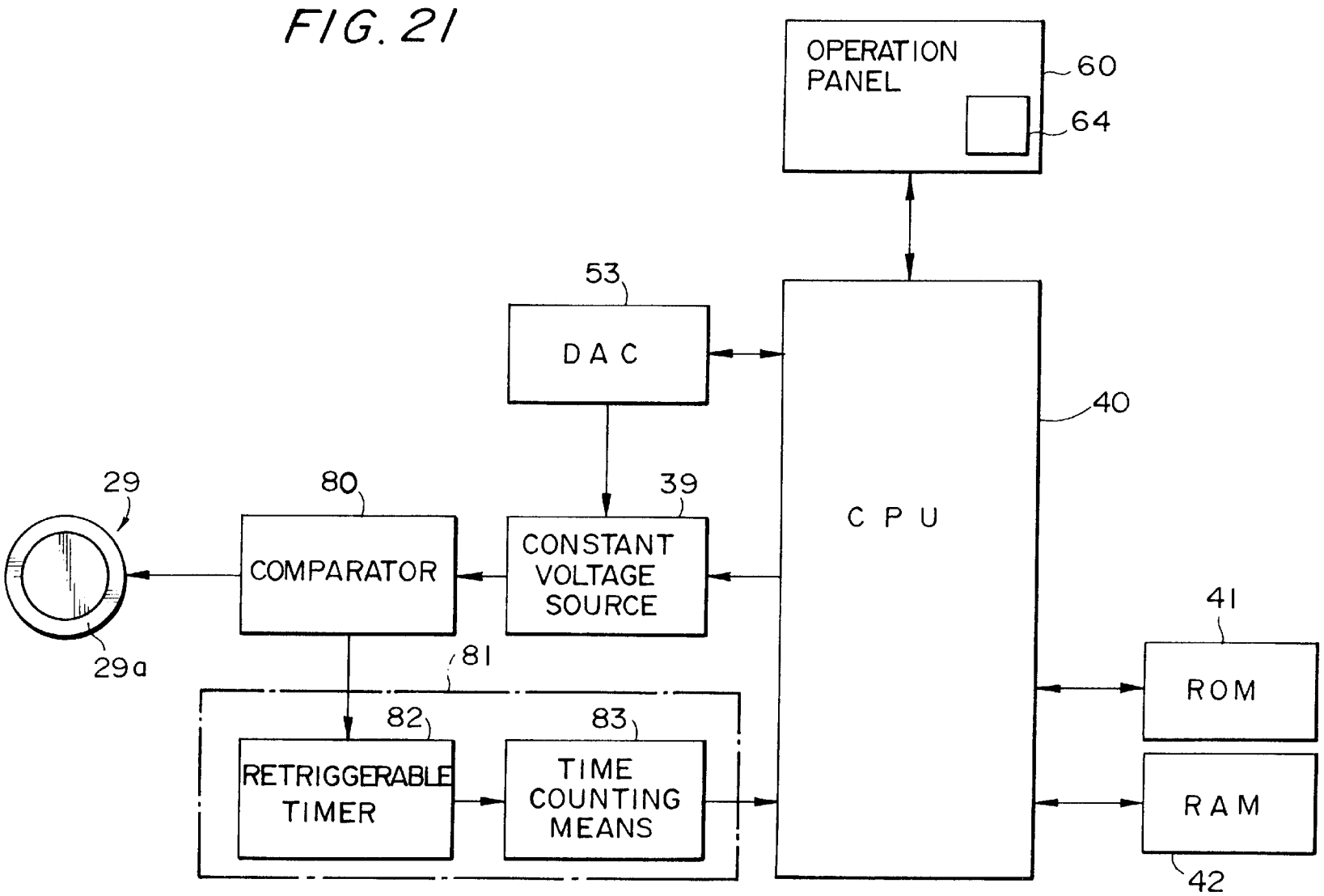
FIG. 21 shows a sixth embodiment of the present invention.

FIG. 21 shows the sixth embodiment in a schematic block diagram. In FIG. 21, the same or similar structural elements as or to the elements shown in FIG. 15 are designated by identical reference numerals, and a detailed description will not be made in order to avoid redundancy. As shown, a press roller 29 has its surface covered with an insulating layer 29*a* implemented by a fluorine- or epoxy-based paint. The constant voltage power source 39 included in one modification of the first embodiment is connected to the press roller 29. A comparator or current sensing means 80 is connected between the power source 39 and the press roller 29 in order to sense a current flowing to the press roller 29. The comparator 80 compares a current flowing to the press roller 29 with a preselected reference current to see if the current is normal. When the actual current exceeds the reference current, the comparator 80 determines that an unusual current has flown to the roller 29, and feeds an unusual current signal to a retriggerable timer 82 which will be described.

Decision means 81 is connected to the comparator 80 for determining whether or not the press roller 29 is normal. The decision means 81 is made up of the retriggerable timer 82 and time counting means 83. The retriggerable timer 82 is automatically reset on the elapse of a period of time longer than the period of time necessary for the roller 29 to complete one rotation. The time counting means 83 counts a period of time during which the timer 82 remains in its ON state. The timer 82 starts counting time in response to the output signal of the comparator 80. The time counting means 83 compares the time being counted by the timer 82 with a preselected reference period of time. If the timer 82 counts a time longer than the reference period of time, then the time counting means 83 determines that the roller 29 is abnormal, i.e., a pin hole is formed in the roller 29, and sends its output to the CPU 40.

Figure 22:
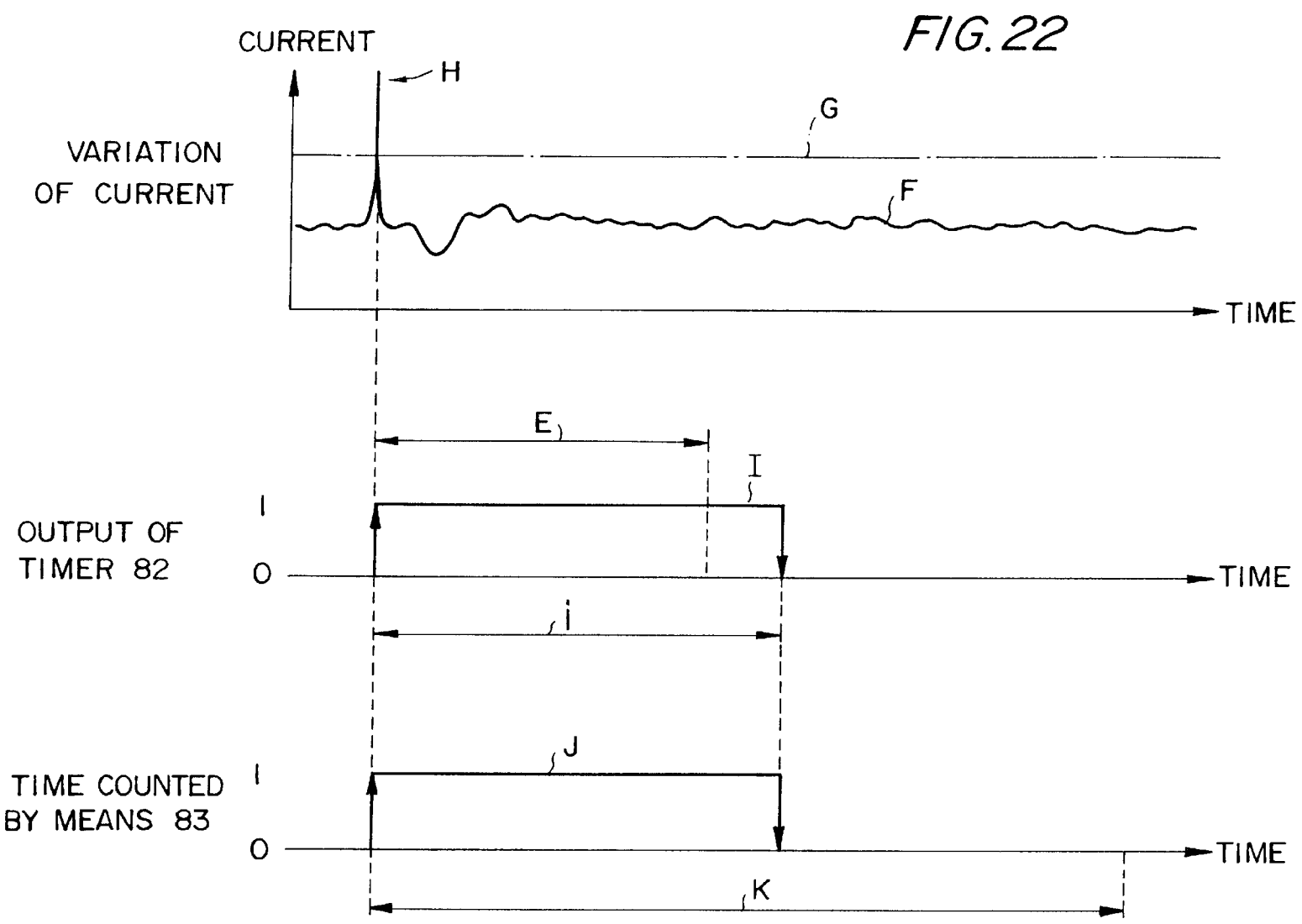
FIG. 22 shows a current to flow through a comparator, the operation of a retriggerable timer, and the duration of ON state of the timer measured when the press roller is free from defects.

What occurs when the press roller 29 is free from the pin hole will be described with reference to FIG. 22. There are shown in FIG. 22 a variation F of the current flowing to the press roller 29, a reference current G assigned to the comparator 80, a spike noise H ascribable to the temporary current flowing to the roller 29 for forming the electric field, a period of time I counted by the timer 82, a preselected basic period of time i assigned to the timer 82, a period of time J counted by the time counting means 83, and a reference period of time K assigned to the time counting means 83. Labeled E in FIG. 22 is identical with the period of time E shown in FIG. 20.

As shown in FIG. 22, when the comparator 80 detects the current exceeding the threshold G and for forming the electric field, the comparator 80 feeds a signal to the timer 82 for causing it to start counting time. On the elapse of the basic period of time i longer than the period of time E, the timer 82 is automatically reset. At the same time, the time counting means 83 counts the duration J of the ON state of the timer 82 while comparing it with the reference period of time K. Because the duration J is shorter than the reference period of time K, the time counting means 83 determines that the roller 29 is normal.

Figure 23:
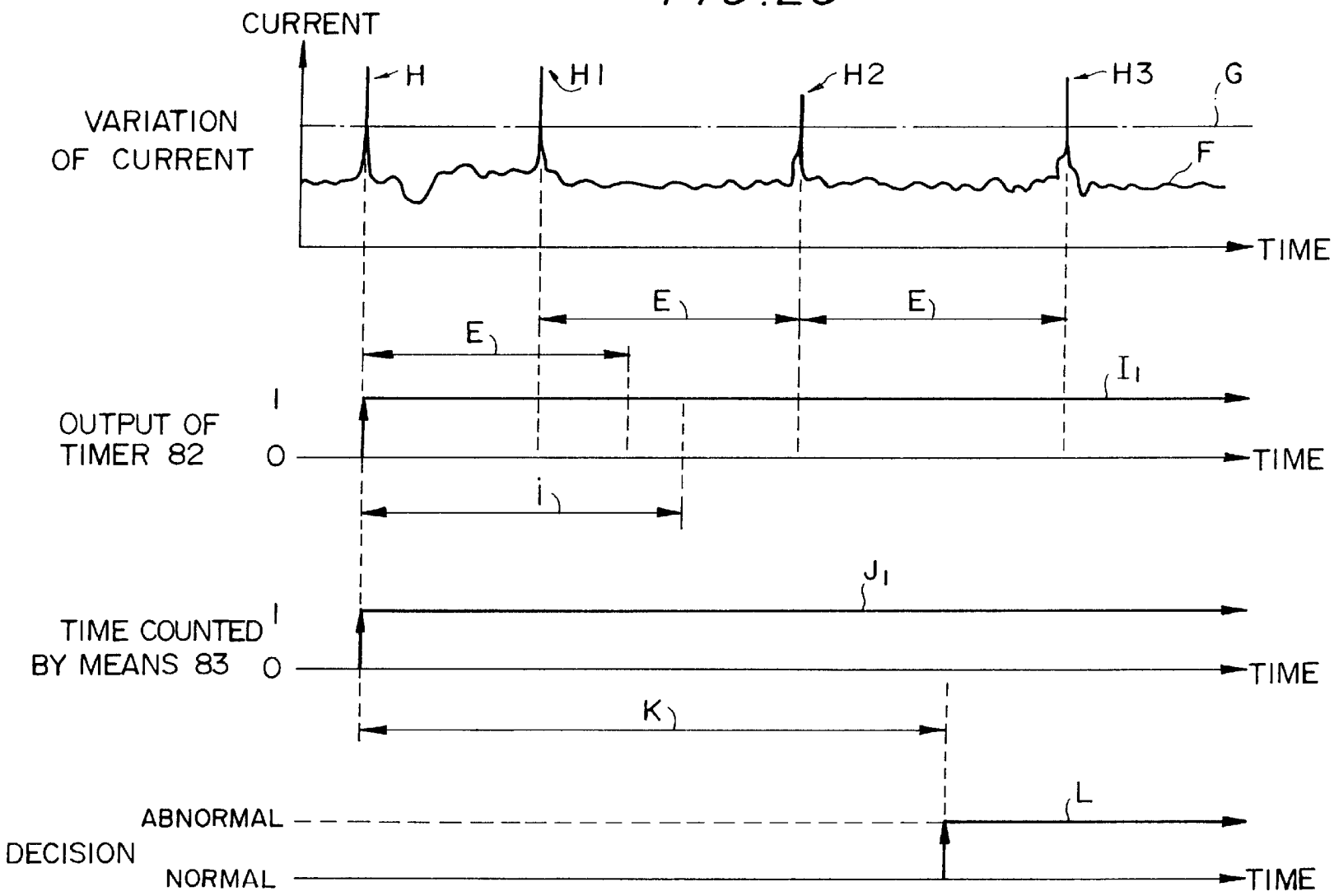
FIG. 23 shows the current to flow through the comparator, the operation of the retriggerable timer, the duration of ON state of the timer and a result of decision measured when the press roller is defective.

FIG. 23 shows a condition wherein the pin hole is formed in the press roller 29. There are shown in FIG. 23 spike noise H1, H2 and H3 flowing to the press roller 29 due to the pin hole, a period of time I1 counted by the timer 82, a period of time J1 counted by the time counting means 83, and an error signal L. In FIG. 23, labels identical with the labels of FIG. 22 denote identical components. First, the comparator 80 feeds a signal to the timer 82 for causing to to start counting time, as in the case shown in FIG. 22. While the timer 82 is counting time, i.e., before the period of time E necessary for the roller 29 to complete one rotation expires, a current (noise H1) exceeding the reference current G again flows to the roller 29 due to the pin hole. In response, the comparator 80 again feeds the signal for causing the timer 82 to operate to the timer 82. As a result, the timer 82 again starts counting time without being reset even after its basic period of time i has expired. In the same manner, the timer 82 repeatedly starts counting time due to the consecutive currents or noise H2 and H3 before it has been reset.

While the timer 82 continuously counts time without being reset, the timer counting time 83 continuously counts the duration J1 of the ON state of the timer 82 while comparing it with the reference period of time K. When the actual period of time J1 exceeds the reference period of time K, the time counting means 83 sends the error signal L to the CPU 40 while determining that the roller 29 is abnormal, i.e., that at least one pin hole has been formed in the roller 29. In response to the error signal L, the CPU 40 stops the application of the voltage to the roller 29, stops the operation of the printer, and turns on the alarm lamp 64 of the operation panel 60 to alert the operator to the error.

As stated above, the illustrative embodiment is capable of detecting the pin hole as soon as it is formed in the roller 29. This successfully obviates a serious error ascribable to such a defect. If desired, the decision means 81 may be replaced with a decision program which compares the time being counted by the timer 82 with the reference period of time K, and determines whether or not the roller 29 is defective on the basis of the result of comparison. In such a case, the decision program will be stored in the ROM 41 beforehand and will be read out at the time for determining whether or not the roller 29 is defective; the CPU 40 will make a decision on the signal input from the timer 82 with the decision program. If the flow of a great current to the roller 29 for discharging the roller 29 is known beforehand, as in the second embodiment, then a circuit or a function for invalidating the output of the decision means 81 when the great current flows may be added to the decision means 81.

In the embodiments shown and described, the pressing means is implemented as a press roller. Alternatively, the press roller may, of course, be replaced with a press drum. A press drum reduces the mechanical pressure to act on the print drum, and therefore increases the ratio of ink transfer to be caused by the electric field, compared to the press roller. The press roller has on its outer periphery a conductive layer to which the voltage is applied, and a high resistance layer surrounding the conductive layer. In this configuration, the electric field is formed between the print drum and the press drum and exerts electric attraction on the ink. Therefore, with the press drum, it is possible to obviate an irregular pressure distribution, and therefore to increase the amount of ink transfer.

In summary, it will be seen that the present invention provides a stencil printer having various unprecedented advantages, as enumerated below.

(1) When a pressing member presses a print drum, an electric field is formed between the pressing member and the print drum in the direction in which ink migrates from the drum to a paper or similar recording medium. The ink provided with induction charge by the electric field is attracted toward and deposited on the paper. As a result, the amount of ink oozing out from the print drum increases. This allows the density of a printed image to be increased without the pressure of the pressing member being increased. Because the pressure of the pressing member is low, support members supporting the print drum are free from damage while the drum achieves extended durability. In addition, noise ascribable to the contact of the pressing member with the print drum is reduced. Even when the print drum is formed with pores of small diameter in a high density and is therefore low in rigidity, it is prevented from deforming during printing. Therefore, high quality printings achieving both of high tonality and high resolution are insured.

(2) To form the above electric field, the print drum is constantly connected to ground while a voltage is applied from voltage feeding means to the pressing member when the member presses the drum. The drum is protected from the influence of discharge occurring at the time of forming the electric field, enhancing the reliability of the printer.

(3) Because the pressing member has an insulating layer or a medium resistance layer in its radially outermost portion, the electric field can be formed stably without any critical shorting or discharge. In addition, greater power can be fed to such a pressing member than to a pressing member lacking the insulating layer or the medium resistance layer, forming a more intense electric field.

(4) The power feeding means is implemented as a constant current power source or a constant voltage power source with an overcurrent protection device. Therefore, power greater than a preselected value is not fed to the pressing member. This prevents shorting or similar fault from being aggravated.

(5) Because the power feeding means is an AC power source or a pulsation power source, a discharging effect is available for the pressing member.

(6) When the pressing member is not pressing the print drum, discharging means discharges the pressing member by forming an electric field between the pressing member and a discharging member and opposite in polarity to the electric field to be formed between the print drum and the pressing member. This prevents charge from depositing on the pressing member and cleans the surface of the member. Consequently, a paper and dust are prevented from adhering to the pressing member and bringing about a trouble.

(7) The printer includes image density setting means for setting the density of an image to be printed on a paper, and control means for adjusting, based on the density selected, the amount of power to be fed from the power feeding means to the pressing member. The operator is therefore capable of adjusting the image density by simple manipulation while seeing the density of an image actually printed on a paper.

(8) The control means compares image density sensed by image density sensing means and image density stored in image density storing means, and automatically controls the power to be fed to the pressing member such that the sensed density coincides with the stored density. The operator therefore does not have to adjust the image density frequently. Once the image density is stored, high quality printings with uniform density are achievable at all times.

(9) Assume that while the automatic adjustment of the power to be fed to the pressing member is under way, the image density is adjusted by hand on the image density setting means. Then, the amount of power set at the time of automatic adjustment is temporarily handed over, obviating a sharp change in image density. In addition, because priority is given to the manual adjustment, the operator is allowed to attain desired image density.

(10) When a desired kind of ink is designated on ink designating means, the control means selects, among various voltage adjustable ranges and reference amounts of power each assigned to a particular kind of ink, the adjustable range and reference amount matching the desired kind of ink, and executes printing therewith. Therefore, the optimal adjustable range and reference amount can be readily set up in matching relation to the ink to be used. This saves time and labor for the adjustment of image density and insures high quality printings.

(11) When an ink storing member storing ink therein is mounted to the printer, ink identifying means automatically identifies the ink. The control means selects, among the voltage adjustable ranges and reference amounts of power, the adjustable range and reference amount matching the kind of the identified ink, and executes printing therewith. This promotes the automatic operation of the printer and obviates the operator's erroneous operation while reducing the load on the operator. Further, the adjustable range and reference amount matching the ink can be automatically set with accuracy.

(12) When the ink storing member is mounted to the printer, the ink identifying means detects the date of production of the ink. The control means computes the time elapses since the date of production detected, and then corrects the voltage adjustable range and reference amount on the basis of the computed time. This correction extends the usable period of the ink despite the aging of the ink and thereby maintains desirable image density.

(13) When the ink storing member is mounted to the printer, ignitability determining means determines the degree of ignitability of gas ascribable to the evaporation of the ink. When the degree of ignitability is high or when the kind of the ink cannot be identified by the ink identifying means, the control means informs the operator of the fact that the ink is inadequate, while inhibiting the ink from being fed to the print drum. This obviates troubles ascribable to the use of inadequate ink.

(14) The printer includes power sensing means for sensing the amount of power being fed to the pressing member, and decision means for determining, based on the sensed amount of power, whether or not the pressing member is defective. When the decision means determines that the pressing means is defective, the control means stops the feed of power to the pressing member and the operation of the printer while producing an alarm. Therefore, any defect of the pressing member which would turn out a serious problem can be detected in its initial stage.

Various modifications will become possible for those skilled in the art after receiving the teachings of the present disclosure without departing from the scope thereof.

What is claimed is:

1. A stencil printer comprising:

a print drum for receiving ink with a master wrapped therearound;

a pressing member for pressing a recording medium against the master to thereby cause the ink to ooze out onto the recording medium;

electric field forming means for forming, when said pressing member presses the recording medium against the master, an electric field between said print drum and said pressing member in a direction in which the ink migrates from said print drum toward the recording medium; and means for adjusting an intensity of said electric field.

2. A printer as claimed in claim 1, further comprising power feeding means for feeding power to said pressing member when said pressing member presses the recording medium, and grounding means for connecting said print drum to ground.

3. A printer as claimed in claim 2, wherein said pressing member includes an outermost layer implemented as either an insulating layer or a layer having an electrical resistance lower than an insulating layer.

4. A printer as claimed in claim 3, wherein said power feeding means comprises either a constant current power source or a constant voltage power source with an overcurrent protection device.

5. A printer as claimed in claim 3, wherein said power feeding means comprises either an AC power source or a pulsation power source.

6. A printer as claimed in claim 3, further comprising a discharging member adjoining said pressing member, and discharging means for forming, when said pressing member is not pressing the recording medium, an electric field opposite in polarity to said electric field formed between said print drum and said pressing member to thereby discharge said pressing member.

7. A printer as claimed in claim 3, wherein said means for adjusting an intensity of said electric field comprises image density setting means for setting a density of an image to be printed on the recording medium, and control means for adjusting, based on the image density set, an amount of power to be fed from said power feeding means to said pressing member.

8. A printer as claimed in claim 7, further comprising:

image density sensing means for sensing a density corresponding to the image density to be printed on the recording medium; and image density storing means for storing the image density to be printed on the recording medium;

wherein said control means compares the image density sensed by said image density sensing means and the image density stored in said image density storing means, and automatically adjusts the amount of power to be fed from said power feeding means to said pressing member such that the density sensed coincides with the image density stored.

9. A printer as claimed in claim 8, wherein when the image density is set on said image density setting means while automatic adjustment of the amount of power is under way, said control means holds the amount of power corresponding to the image density stored in said image density storing means, and gives priority to adjustment to be performed on said image density setting means.

10. A printer as claimed in claim 7, further comprising ink designating means for designating a kind of ink to be used for printing and control means for storing adjustable power ranges and reference amounts of power each assigned to a particular kind of ink and selecting one of said adjustable power ranges and one of said reference amounts of power matching the kind of ink designated on said ink designating means.

11. A printer as claimed in claim 7, further comprising ink identifying means for automatically identifying, when an ink storing member storing ink is mounted to said printer, a kind of the ink and control means for selecting a power adjustable range and a reference amount of power matching the kind of the ink identified by said ink identifying means.

12. A printer as claimed in claim 11, wherein said ink identifying means identifies a date of production of the ink, and wherein said control means computes a time elapsed since the date of production identified by said ink identifying means and corrects the adjustable power range and the reference amount of power in accordance with the time elapsed.

13. A printer as claimed in claim 11, further comprising ink ignitability determining means for determining, when said ink storing member is mounted to said printer, a degree of ignitability of gas ascribable to evaporation of the ink stored in said ink storing member, wherein said control means reports, when the kind of the ink cannot be identified by said ink identifying means or when the degree of ignitability determined by said ink ignitability determining means is high, that the ink is inadequate for printing, and inhibits the ink from being fed to said print drum.

14. A printer as claimed in claim 7, further comprising power sensing means for sensing an amount of power being fed to said pressing member, decision means for determining, based on the amount of power sensed, whether or not said pressing member is defective and control means for stopping, when said pressing member is determined to be defective by said decision means, feed of the power to said pressing member, stopping a printing operation of said printer, and producing an alarm indicative of a defect of said pressing member.

15. A printer as claimed in claim 3, further comprising ink designating means for designating a kind of ink to be used for printing and control means for storing adjustable power ranges and reference amounts of power each assigned to a particular kind of ink and selecting one of said adjustable power ranges and one of said reference amounts of power matching the kind of ink designated on said ink designating means.

16. A printer as claimed in claim 3, further comprising ink identifying means for automatically identifying, when an ink storing member storing ink is mounted to said printer, a kind of the ink and control means for selecting a power adjustable range and a reference amount of power matching the kind of the ink identified by said ink identifying means.

17. A printer as claimed in claim 16, wherein said ink identifying means identifies a date of production of the ink, and wherein said control means computes a time elapsed since the date of production identified by said ink identifying means and corrects the adjustable power range and the reference amount of power in accordance with the time elapsed.

18. A printer as claimed in claim 16, further comprising ink ignitability determining means for determining, when said ink storing member is mounted to said printer, a degree of ignitability of gas ascribable to evaporation of the ink stored in said ink storing member, wherein said control means reports, when the kind of the ink cannot be identified by said ink identifying means or when the degree of ignitability determined by said ink ignitability determining means is high, that the ink is inadequate for printing, and inhibits the ink from being fed to said print drum.

19. A printer as claimed in claim 3, further comprising power sensing means for sensing an amount of power being fed to said pressing member, decision means for determining, based on the amount of power sensed, whether or not said pressing member is defective, and control means for stopping, when said pressing member is determined to be defective by said decision means, feed of the power to said pressing member, stopping a printing operation of said printer, and producing an alarm indicative of a defect of said pressing member.

20. A printer as claimed in claim 2, wherein said power feeding means comprises either a constant current power source or a constant voltage power source with an overcurrent protection device.

21. A printer as claimed in claim 2, wherein said power feeding means comprises either an AC power source or a pulsation power source.

22. A printer as claimed in claim 2, further comprising a discharging member adjoining said pressing member, and discharging means for forming, when said pressing member is not pressing the recording medium, an electric field opposite in polarity to said electric field formed between said print drum and said pressing member to thereby discharge said pressing member.

23. A printer as claimed in claim 2, further comprising image density setting means for setting a density of an image to be printed on the recording medium, and control means for adjusting, based on the image density set, an amount of power to be fed from said power feeding means to said pressing member.

24. A printer as claimed in claim 23, further comprising:

image density sensing means for sensing a density corresponding to the image density to be printed on the recording medium; and image density storing means for storing the image density to be printed on the recording medium;

wherein said control means compares the density sensed by said image density sensing means and the image density stored in said image density storing means, and automatically adjusts the amount of power to be fed from said power feeding means to said pressing member such that the density sensed coincides with the image density stored.

25. A printer as claimed in claim 24, wherein when the image density is set on said image density setting means while automatic adjustment of the amount of power is under way, said control means holds the amount of power corresponding to the image density stored in said image density storing means, and gives priority to adjustment to be performed on said image density setting means.

26. A printer as claimed in claim 23, further comprising ink designating means for designating a kind of ink to be used for printing and control means for storing adjustable power ranges and reference amounts of power each assigned to a particular kind of ink and selecting one of said adjustable power ranges and one of said reference amounts of power matching the kind of ink designated on said ink designating means.

27. A printer as claimed in claim 23, further comprising ink identifying means for automatically identifying, when an ink storing member storing ink is mounted to said printer, a kind of the ink and control means for selecting a power adjustable range and a reference amount of power matching the kind of the ink identified by said ink identifying means.

28. A printer as claimed in claim 27, wherein said ink identifying means identifies a date of production of the ink, and wherein said control means computes a time elapsed since the date of production identified by said ink identifying means and corrects the adjustable power range and the reference amount of power in accordance with the time elapsed.

29. A printer as claimed in claim 27, further comprising ink ignitability determining means for determining, when said ink storing member is mounted to said printer, a degree of ignitability of gas ascribable to evaporation of the ink stored in said ink storing member, wherein said control means reports, when the kind of the ink cannot be identified by said ink identifying means or when the degree of ignitability determined by said ink ignitability determining means is high, that the ink is inadequate for printing, and inhibits the ink from being fed to said print drum.

30. A printer as claimed in claim 23, further comprising power sensing means for sensing an amount of power being fed to said pressing member, decision means for determining, based on the amount of power sensed, whether or not said pressing member is defective and control means for stopping, when said pressing member is determined to be defective by said decision means, feed of the power to said pressing member, stopping a printing operation of said printer, and producing an alarm indicative of a defect of said pressing member.

31. A printer as claimed in claim 2, further comprising ink designating means for designating a kind of ink to be used for printing and control means for storing adjustable power ranges and reference amounts of power each assigned to a particular kind of ink and selecting one of said adjustable power ranges and one of said reference amounts of power matching the kind of ink designated on said ink designating means.

32. A printer as claimed in claim 2, further comprising ink identifying means for automatically identifying, when an ink storing member storing ink is mounted to said printer, a kind of the ink and control means for selecting a power adjustable range and a reference amount of power matching the kind of the ink identified by said ink identifying means.

33. A printer as claimed in claim 32, wherein said ink identifying means identifies a date of production of the ink, and wherein said control means computes a time elapsed since the date of production identified by said ink identifying means and corrects the adjustable power range and the reference amount of power in accordance with the time elapsed.

34. A printer as claimed in claim 32, further comprising ink ignitability determining means for determining, when said ink storing member is mounted to said printer, a degree of ignitability of gas ascribable to evaporation of the ink stored in said ink storing member, wherein said control means reports, when the kind of the ink cannot be identified by said ink identifying means or when the degree of ignitability determined by said ink ignitability determining means is high, that the ink is inadequate for printing, and inhibits the ink from being fed to said print drum.

35. A printer as claimed in claim 2, further comprising power sensing means for sensing an amount of power being fed to said pressing member, decision means for determining, based on the amount of power sensed, whether or not said pressing member is defective and control means for stopping, when said pressing member is determined to be defective by said decision means, feed of the power to said pressing member, stopping a printing operation of said printer, and producing an alarm indicative of a defect of said pressing member.

36. A printer as claimed in claim 1, wherein said pressing member has an outermost layer implemented as either an insulating layer or a layer having an electrical resistance lower than an insulating layer.

37. A printer as claimed in claim 36, wherein said power feeding means comprises either a constant current power source or a constant voltage power source with an overcurrent protection device.

38. A printer as claimed in claim 36, wherein said power feeding means comprises either an AC power source or a pulsation power source.

39. A printer as claimed in claim 36, further comprising a discharging member adjoining said pressing member, and discharging means for forming, when said pressing member is not pressing the recording medium, an electric field opposite in polarity to said electric field formed between said print drum and said pressing member to thereby discharge said pressing member.

* * * * *

UNITED STATES PATENT AND TRADEMARK OFFICE

CERTIFICATE OF CORRECTION

PATENT NO. : 5,937,750

DATED : AUGUST 17, 1999

INVENTOR(S) : Fuchio TAKEDA

It is certified that error appears in the above-identified patent and that said Letters Patent is hereby corrected as shown below:

Column 14, line 9, delete "the".

Column 16, line 26, change "20" to --26--.

Signed and Sealed this

Nineteenth Day of December, 2000

*Attest:*

Q. TODD DICKINSON

*Attesting Officer*

*Commissioner of Patents and Trademarks*